US010531691B2

(12) United States Patent
Sears et al.

(10) Patent No.: US 10,531,691 B2
(45) **Date of Patent: *Jan. 14, 2020**

(54) AEROSOL DELIVERY DEVICE

(71) Applicant: RAI Strategic Holdings, Inc., Winston-Salem, NC (US)

(72) Inventors: Stephen Benson Sears, Siler City, NC (US); Timothy Brian Nestor, Advance, NC (US); Charles Jacob Novak, III, Winston-Salem, NC (US); Steven Lee Alderman, Lewisville, NC (US); Michael Ryan Galloway, Winston-Salem, NC (US); Quentin Paul Guenther, Jr., Winston-Salem, NC (US); Frederic Philippe Ampolini, Winston-Salem, NC (US); Raymond C. Henry, Jr., Cary, NC (US); Allen Michael East, Cary, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/022,436

(22) Filed: Jun. 28, 2018

(65) Prior Publication Data

US 2018/0303169 A1 Oct. 25, 2018

Related U.S. Application Data

(63) Continuation of application No. 13/647,000, filed on Oct. 8, 2012, now Pat. No. 10,117,460.

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS 1,771,366 A 7/1930 Wyss et al.
2,057,353 A 10/1936 Whittemore, Jr.
(Continued)

FOREIGN PATENT DOCUMENTS

AU 276250 7/1965
CA 2 641 869 5/2010
(Continued)

OTHER PUBLICATIONS

E-Cigarette; May 2010; https://www.e-cigarette-forum.com/forum/threads/bn-how-does-one-use-madvapes-reward-points.130761/.
(Continued)

*Primary Examiner* — Eric Yaary
(74) *Attorney, Agent, or Firm* — Womble Bond Dickinson (US) LLP

(57) ABSTRACT

Smoking articles, and methods for forming such smoking articles, such as an electronic smoking article, are provided. An exemplary smoking article comprises a control body portion having a control body engagement end, and having a first control component therein. A cartridge body portion includes a cartridge body engagement end configured to removably engage the control body engagement end of the control body portion. The cartridge body portion further includes a consumable arrangement comprising at least an aerosol precursor composition and at least one heating element operably engaged therewith, and a second control component. At least the consumable arrangement is configured to be in communication with the first control component upon engagement between the cartridge body and control body portions.

19 Claims, 7 Drawing Sheets

(56) References Cited

U.S. PATENT DOCUMENTS 2,104,266 A 1/1938 McCormick
2,805,669 A 9/1957 Meriro
3,200,819 A 8/1965 Gilbert
3,316,919 A 5/1967 Green et al.
3,398,754 A 8/1968 Tughan
3,419,015 A 12/1968 Wochnowski
3,424,171 A 1/1969 Rooker
3,476,118 A 11/1969 Luttich
4,054,145 A 10/1977 Berndt et al.
4,131,117 A 12/1978 Kite et al.
4,150,677 A 4/1979 Osborne
4,190,046 A 2/1980 Virag
4,219,032 A 8/1980 Tabatznik et al.
4,259,970 A 4/1981 Green, Jr.
4,284,089 A 8/1981 Ray
4,303,083 A 12/1981 Burruss, Jr.
4,449,541 A 5/1984 Mays et al.
4,506,682 A 3/1985 Muller
4,635,651 A 1/1987 Jacobs
4,674,519 A 6/1987 Keritsis et al.
4,708,151 A 11/1987 Shelar
4,714,082 A 12/1987 Baneijee et al.
4,735,217 A 4/1988 Gerth et al.
4,756,318 A 7/1988 Clearman et al.
4,771,795 A 9/1988 White et al.
4,776,353 A 10/1988 Lilja et al.
4,793,365 A 12/1988 Sensabaugh, Jr. et al.
4,800,903 A 1/1989 Ray et al.
4,819,665 A 4/1989 Roberts et al.
4,821,749 A 4/1989 Toft et al.
4,830,028 A 5/1989 Lawson et al.
4,836,224 A 6/1989 Lawson et al.
4,836,225 A 6/1989 Sudoh
4,848,374 A 7/1989 Chard et al.
4,848,376 A 7/1989 Lilja et al.
4,874,000 A 10/1989 Tamol et al.
4,880,018 A 11/1989 Graves, Jr. et al.
4,887,619 A 12/1989 Burcham, Jr. et al.
4,907,606 A 3/1990 Lilja et al.
4,913,168 A 4/1990 Potter et al.
4,917,119 A 4/1990 Potter et al.
4,917,128 A 4/1990 Clearman et al.
4,922,901 A 5/1990 Brooks et al.
4,924,888 A 5/1990 Perfetti et al.
4,928,714 A 5/1990 Shannon
4,938,236 A 7/1990 Banerjee et al.
4,941,483 A 7/1990 Ridings et al.
4,941,484 A 7/1990 Clapp et al.
4,945,931 A 8/1990 Gori
4,947,874 A 8/1990 Brooks et al.
4,947,875 A 8/1990 Brooks et al.
4,972,854 A 11/1990 Kiernan et al.
4,972,855 A 11/1990 Kuriyama et al.
4,986,286 A 1/1991 Roberts et al.
4,987,906 A 1/1991 Young et al.
5,005,593 A 4/1991 Fagg
5,019,122 A 5/1991 Clearman et al.
5,022,416 A 6/1991 Watson
5,042,510 A 8/1991 Curtiss et al.
5,060,671 A 8/1991 Counts et al.
5,056,537 A 10/1991 Brown et al.
5,060,669 A 10/1991 White et al.
5,065,775 A 11/1991 Fagg
5,072,744 A 12/1991 Luke et al.
5,074,319 A 12/1991 White et al.
5,076,296 A 12/1991 Nystrom et al.
5,093,894 A 3/1992 Deevi et al.
5,095,921 A 3/1992 Losee et al.
5,097,850 A 3/1992 Braunshteyn et al.
5,099,862 A 3/1992 White et al.
5,099,864 A 3/1992 Young et al.
5,103,842 A 4/1992 Strang et al.
5,121,757 A 6/1992 White et al.
5,129,409 A 7/1992 White et al.
5,131,415 A 7/1992 Munoz et al.
5,144,962 A 8/1992 Counts et al.
5,143,097 A 9/1992 Sohn et al.
5,146,934 A 9/1992 Deevi et al.
5,159,940 A 11/1992 Hayward et al.
5,159,942 A 11/1992 Brinkley et al.
5,179,966 A 1/1993 Losee et al.
5,211,684 A 5/1993 Shannon et al.
5,220,930 A 6/1993 Gentry
5,224,498 A 7/1993 Deevi et al.
5,228,460 A 7/1993 Sprinkel, Jr. et al.
5,230,354 A 7/1993 Smith et al.
5,235,992 A 8/1993 Sensabaugh
5,243,999 A 9/1993 Smith
5,246,018 A 9/1993 Deevi et al.
5,249,586 A 10/1993 Morgan et al.
5,261,424 A 11/1993 Sprinkel, Jr.
5,269,327 A 12/1993 Counts et al.
5,285,798 A 2/1994 Banerjee et al.
5,293,883 A 3/1994 Edwards
5,301,694 A 4/1994 Raymond
5,303,720 A 4/1994 Banerjee et al.
5,318,050 A 6/1994 Gonzalez-Parra et al.
5,322,075 A 6/1994 Deevi et al.
5,322,076 A 6/1994 Brinkley et al.
5,326,207 A 7/1994 Cerny
5,339,838 A 8/1994 Young et al.
5,345,951 A 9/1994 Serrano et al.
5,353,813 A 10/1994 Deevi et al.
5,354,134 A 10/1994 Patry
5,357,984 A 10/1994 Farrier et al.
5,360,023 A 11/1994 Blakley et al.
5,369,723 A 11/1994 Counts et al.
5,372,148 A 12/1994 McCafferty et al.
5,377,698 A 1/1995 Litzinger et al.
5,388,574 A 2/1995 Ingebrethsen et al.
5,388,594 A 2/1995 Counts et al.
5,408,574 A 4/1995 Deevi et al.
5,435,325 A 7/1995 Clapp et al.
5,445,169 A 8/1995 Brinkley et al.
5,468,266 A 11/1995 Bensalem et al.
5,468,936 A 11/1995 Deevi et al.
5,479,948 A 1/1996 Counts et al.
5,498,850 A 3/1996 Das
5,498,855 A 3/1996 Deevi et al.
5,499,636 A 3/1996 Baggett, Jr. et al.
5,501,237 A 3/1996 Young et al.
5,505,214 A 4/1996 Collins et al.
5,515,842 A 5/1996 Ramseyer et al.
5,530,225 A 6/1996 Hajaligol
5,551,450 A 9/1996 Hemsley
5,551,451 A 9/1996 Riggs et al.
5,564,442 A 10/1996 MacDonald et al.
5,573,692 A 11/1996 Das et al.
5,591,368 A 1/1997 Fleischhauer et al.
5,593,792 A 1/1997 Farrier et al.
5,595,577 A 1/1997 Bensalem et al.
5,596,706 A 1/1997 Sikk et al.
5,611,360 A 3/1997 Tang
5,613,504 A 3/1997 Collins et al.
5,613,505 A 3/1997 Campbell et al.
5,649,552 A 7/1997 Cho et al.
5,649,554 A 7/1997 Sprinkel et al.
5,659,656 A 8/1997 Das
5,665,262 A 9/1997 Hajaligol et al.
5,666,976 A 9/1997 Adams et al.
5,666,977 A 9/1997 Higgins et al.
5,666,978 A 9/1997 Counts et al.
5,687,746 A 11/1997 Rose et al.
5,692,525 A 12/1997 Counts et al.
5,692,526 A 12/1997 Adams et al.
5,708,258 A 1/1998 Counts et al.
5,711,320 A 1/1998 Martin
5,726,421 A 3/1998 Fleischhauer et al.
5,727,571 A 3/1998 Meiring et al.
5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt

(56) References Cited

U.S. PATENT DOCUMENTS

| | | | |
|---|---|---|---|
| 5,829,453 | A | 11/1998 | White et al. |
| 5,865,185 | A | 2/1999 | Collins et al. |
| 5,865,186 | A | 2/1999 | Volsey, II |
| 5,878,752 | A | 3/1999 | Adams et al. |
| 5,880,439 | A | 3/1999 | Deevi et al. |
| 5,894,841 | A | 4/1999 | Voges |
| 5,902,501 | A | 5/1999 | Nunnally et al. |
| 5,915,387 | A | 6/1999 | Baggett, Jr. et al. |
| 5,934,289 | A | 8/1999 | Watkins et al. |
| 5,954,979 | A | 9/1999 | Counts et al. |
| 5,967,148 | A | 10/1999 | Harris et al. |
| 6,026,820 | A | 2/2000 | Baggett, Jr. et al. |
| 6,033,506 | A | 3/2000 | Klett |
| 6,033,623 | A | 3/2000 | Deevi et al. |
| 6,037,032 | A | 3/2000 | Klett et al. |
| 6,040,560 | A | 3/2000 | Fleischhauer et al. |
| 6,053,176 | A | 4/2000 | Adams et al. |
| 6,089,857 | A | 7/2000 | Matsuura et al. |
| 6,095,153 | A | 8/2000 | Kessler et al. |
| 6,116,247 | A | 9/2000 | Banyasz et al. |
| 6,119,700 | A | 9/2000 | Fleischhauer et al. |
| 6,125,853 | A | 10/2000 | Susa et al. |
| 6,125,855 | A | 10/2000 | Nevett et al. |
| 6,125,866 | A | 10/2000 | Nichols et al. |
| 6,155,268 | A | 12/2000 | Takeuchi |
| 6,164,287 | A | 12/2000 | White |
| 6,182,670 | B1 | 2/2001 | White |
| 6,196,218 | B1 | 3/2001 | Voges |
| 6,196,219 | B1 | 3/2001 | Hess |
| 6,216,706 | B1 | 4/2001 | Kumar et al. |
| 6,289,898 | B1 | 9/2001 | Fournier et al. |
| 6,349,729 | B1 | 2/2002 | Pham |
| 6,357,671 | B1 | 3/2002 | Cewers |
| 6,418,938 | B1 | 7/2002 | Fleischhauer et al. |
| 6,446,426 | B1 | 8/2002 | Sweeney et al. |
| 6,532,965 | B1 | 3/2003 | Abhulimen et al. |
| 6,598,607 | B2 | 7/2003 | Adiga et al. |
| 6,601,776 | B1 | 8/2003 | Oljaca et al. |
| 6,615,840 | B1 | 9/2003 | Fournier et al. |
| 6,637,430 | B1 | 10/2003 | Voges et al. |
| 6,688,313 | B2 | 2/2004 | Wrenn et al. |
| 6,701,936 | B2 | 3/2004 | Shafer et al. |
| 6,715,494 | B1 | 4/2004 | McCoy |
| 6,729,269 | B2 | 5/2004 | Ott et al. |
| 6,730,832 | B1 | 5/2004 | Dominguez et al. |
| 6,772,756 | B2 | 8/2004 | Shayan |
| 6,803,545 | B2 | 10/2004 | Blake et al. |
| 6,803,550 | B2 | 10/2004 | Sharpe et al. |
| 6,810,883 | B2 | 11/2004 | Felter et al. |
| 6,854,461 | B2 | 2/2005 | Nichols et al. |
| 6,854,470 | B1 | 2/2005 | Pu |
| 6,994,096 | B2 | 2/2006 | Rostami et al. |
| 7,011,096 | B2 | 3/2006 | Li et al. |
| 7,017,585 | B2 | 3/2006 | Li et al. |
| 7,025,066 | B2 | 4/2006 | Lawson et al. |
| 7,117,867 | B2 | 10/2006 | Cox et al. |
| 7,131,599 | B2 | 11/2006 | Katase |
| 7,163,015 | B2 | 1/2007 | Moffitt |
| 7,173,322 | B2 | 2/2007 | Cox et al. |
| 7,185,659 | B2 | 3/2007 | Sharpe et al. |
| 7,234,470 | B2 | 6/2007 | Yang |
| 7,290,549 | B2 | 11/2007 | Banerjee et al. |
| 7,293,565 | B2 | 11/2007 | Griffin et al. |
| 7,392,809 | B2 | 7/2008 | Larson et al. |
| 7,513,253 | B2 | 4/2009 | Kobayashi et al. |
| 7,647,932 | B2 | 1/2010 | Cantrell et al. |
| 7,690,385 | B2 | 4/2010 | Moffitt |
| 7,692,123 | B2 | 4/2010 | Baba et al. |
| 7,726,320 | B2 | 6/2010 | Robinson et al. |
| 7,775,459 | B2 | 8/2010 | Martens, III et al. |
| 7,810,505 | B2 | 10/2010 | Yang |
| 7,832,410 | B2 | 11/2010 | Hon |
| 7,845,359 | B2 | 12/2010 | Montaser |
| 7,878,209 | B2 | 2/2011 | Newbery et al. |
| 7,896,006 | B2 | 3/2011 | Hamano et al. |
| 8,066,010 | B2 | 11/2011 | Newbery et al. |
| 8,079,371 | B2 | 12/2011 | Robinson et al. |
| 8,127,772 | B2 | 3/2012 | Montaser |
| 8,156,944 | B2 | 4/2012 | Hon |
| 8,365,742 | B2 | 2/2013 | Hon |
| 8,372,510 | B2 | 2/2013 | Miller et al. |
| 8,375,957 | B2 | 2/2013 | Hon |
| 8,393,331 | B2 | 3/2013 | Hon |
| 8,499,766 | B1 | 8/2013 | Newton |
| 8,528,569 | B1 | 9/2013 | Newton |
| 2002/0146242 | A1 | 10/2002 | Vieira |
| 2002/0164169 | A1 | 11/2002 | Arai et al. |
| 2002/0194064 | A1 | 12/2002 | Parry et al. |
| 2003/0131859 | A1 | 7/2003 | Li et al. |
| 2003/0209245 | A1 | 11/2003 | Poole et al. |
| 2003/0226837 | A1 | 12/2003 | Blake et al. |
| 2004/0017203 | A1 | 1/2004 | Becker et al. |
| 2004/0020500 | A1 | 2/2004 | Wrenn et al. |
| 2004/0065726 | A1 | 4/2004 | McGee et al. |
| 2004/0118401 | A1 | 6/2004 | Smith et al. |
| 2004/0129280 | A1 | 7/2004 | Woodson et al. |
| 2004/0149296 | A1 | 8/2004 | Rostami et al. |
| 2004/0200488 | A1 | 10/2004 | Felter et al. |
| 2004/0224435 | A1 | 11/2004 | Shibata et al. |
| 2004/0226568 | A1 | 11/2004 | Takeuchi et al. |
| 2004/0255965 | A1 | 12/2004 | Perfetti et al. |
| 2004/0261790 | A1 | 12/2004 | Joshi et al. |
| 2005/0016549 | A1 | 1/2005 | Banerjee et al. |
| 2005/0016550 | A1 | 1/2005 | Katase |
| 2005/0066986 | A1 | 3/2005 | Nestor et al. |
| 2005/0151126 | A1 | 7/2005 | Yamakawa et al. |
| 2005/0157578 | A1 | 7/2005 | Noguchi et al. |
| 2005/0172118 | A1 | 8/2005 | Nasu |
| 2005/0172976 | A1 | 8/2005 | Newman et al. |
| 2005/0228991 | A1 | 10/2005 | Schmit |
| 2005/0274390 | A1 | 12/2005 | Banerjee et al. |
| 2006/0016453 | A1 | 1/2006 | Kim |
| 2006/0032501 | A1 | 2/2006 | Hale et al. |
| 2006/0070633 | A1 | 4/2006 | Rostami et al. |
| 2006/0162733 | A1 | 7/2006 | McGrath et al. |
| 2006/0185687 | A1 | 8/2006 | Hearn et al. |
| 2006/0196518 | A1 | 9/2006 | Hon |
| 2006/0248342 | A1 | 11/2006 | Bajar et al. |
| 2007/0074734 | A1 | 4/2007 | Braunshteyn et al. |
| 2007/0102013 | A1 | 5/2007 | Adams et al. |
| 2007/0215167 | A1 | 9/2007 | Crooks et al. |
| 2007/0283972 | A1 | 12/2007 | Monsees et al. |
| 2008/0008511 | A1 | 1/2008 | Chino |
| 2008/0077802 | A1 | 3/2008 | Richardson et al. |
| 2008/0085103 | A1 | 4/2008 | Beland et al. |
| 2008/0092912 | A1 | 4/2008 | Robinson et al. |
| 2008/0149118 | A1 | 6/2008 | Oglesby et al. |
| 2008/0245377 | A1 | 10/2008 | Marshall et al. |
| 2008/0257367 | A1 | 10/2008 | Paterno et al. |
| 2008/0276947 | A1 | 11/2008 | Martzel |
| 2008/0302374 | A1 | 12/2008 | Wengert et al. |
| 2009/0011673 | A1 | 1/2009 | Ko et al. |
| 2009/0065010 | A1 | 3/2009 | Shands |
| 2009/0092252 | A1 | 4/2009 | Noll et al. |
| 2009/0095311 | A1 | 4/2009 | Hon |
| 2009/0095312 | A1 | 4/2009 | Herbrich et al. |
| 2009/0126745 | A1 | 5/2009 | Hon |
| 2009/0151717 | A1 | 6/2009 | Bowen et al. |
| 2009/0188490 | A1 | 7/2009 | Han |
| 2009/0230117 | A1 | 9/2009 | Fernando et al. |
| 2009/0260641 | A1 | 10/2009 | Monsees et al. |
| 2009/0260642 | A1 | 10/2009 | Monsees et al. |
| 2009/0272379 | A1 | 11/2009 | Thorens et al. |
| 2009/0283103 | A1 | 11/2009 | Nielsen et al. |
| 2009/0293892 | A1 | 12/2009 | Williams et al. |
| 2009/0320863 | A1 | 12/2009 | Fernando et al. |
| 2009/0324206 | A1 | 12/2009 | Young et al. |
| 2010/0006113 | A1 | 1/2010 | Urtsev et al. |
| 2010/0024834 | A1 | 2/2010 | Oglesby et al. |
| 2010/0043809 | A1 | 2/2010 | Magnon |
| 2010/0059070 | A1 | 3/2010 | Potter et al. |
| 2010/0059073 | A1 | 3/2010 | Hoffmann et al. |
| 2010/0065075 | A1 | 3/2010 | Banerjee et al. |
| 2010/0083959 | A1 | 4/2010 | Siller |

(56) References Cited

U.S. PATENT DOCUMENTS

2010/0153135 A1 6/2010 Park
2010/0163063 A1 7/2010 Fernando et al.
2010/0200006 A1 8/2010 Robinson et al.
2010/0200008 A1 8/2010 Taieb
2010/0229881 A1 9/2010 Hearn
2010/0242974 A1 9/2010 Pan
2010/0242976 A1 9/2010 Katayama et al.
2010/0258139 A1 10/2010 Onishi et al.
2010/0300467 A1 12/2010 Kuistilla et al.
2010/0307518 A1 12/2010 Wang
2010/0313901 A1 12/2010 Fernando et al.
2011/0005535 A1 1/2011 Xiu
2011/0011396 A1 1/2011 Fang
2011/0036346 A1* 2/2011 Cohen ..... A61M 15/0065 128/200.14
2011/0036363 A1 2/2011 Urtsev et al.
2011/0036365 A1 2/2011 Chong et al.
2011/0073121 A1 3/2011 Levin et al.
2011/0088707 A1 4/2011 Hajaligol
2011/0094523 A1 4/2011 Thorens et al.
2011/0120480 A1 5/2011 Brenneise
2011/0120482 A1* 5/2011 Brenneise ..... A24F 47/008 131/328
2011/0126847 A1 6/2011 Zuber et al.
2011/0126848 A1 6/2011 Zuber et al.
2011/0155153 A1 6/2011 Thorens et al.
2011/0155718 A1 6/2011 Greim et al.
2011/0162663 A1 7/2011 Bryman
2011/0168194 A1 7/2011 Hon
2011/0180082 A1 7/2011 Banerjee et al.
2011/0265806 A1 11/2011 Alarcon et al.
2011/0277760 A1 11/2011 Terry et al.
2011/0290268 A1 12/2011 Schennum
2011/0309157 A1 12/2011 Yang et al.
2012/0042885 A1 2/2012 Stone et al.
2012/0048266 A1 3/2012 Alelov
2012/0060853 A1 3/2012 Robinson et al.
2012/0067357 A1 3/2012 Boutros et al.
2012/0076511 A1 3/2012 Kim et al.
2012/0111347 A1 5/2012 Hon
2012/0132643 A1 5/2012 Choi et al.
2012/0167906 A1 7/2012 Gysland
2012/0199572 A1* 8/2012 Shen ..... A61M 11/041 219/438
2012/0199663 A1 8/2012 Qiu
2012/0227753 A1 9/2012 Newton
2012/0231464 A1 9/2012 Yu et al.
2012/0260926 A1 10/2012 Tu et al.
2012/0279512 A1 11/2012 Hon
2012/0318882 A1 12/2012 Abehasera
2013/0042865 A1 2/2013 Monsees et al.
2013/0056888 A1 3/2013 Holakovsky et al.
2013/0081625 A1 4/2013 Rustad et al.
2013/0081642 A1 4/2013 Safari
2013/0192621 A1 8/2013 Li et al.
2013/0192622 A1 8/2013 Tucker et al.
2013/0199528 A1 8/2013 Goodman et al.
2013/0213419 A1 8/2013 Tucker et al.
2013/0220315 A1 8/2013 Conley et al.
2013/0228190 A1* 9/2013 Weiss ..... A24F 47/002 131/328
2013/0228191 A1 9/2013 Newton
2013/0233313 A1 9/2013 Young et al.
2013/0247924 A1 9/2013 Scatterday et al.
2013/0253427 A1* 9/2013 Cerman ..... A61M 5/24 604/111
2013/0276799 A1 10/2013 Davidson et al.
2013/0284194 A1* 10/2013 Newton ..... A24F 47/008 131/329
2013/0298905 A1* 11/2013 Levin ..... A24F 47/008 128/202.21
2013/0306064 A1 11/2013 Thorens et al.
2013/0306084 A1 11/2013 Flick
2013/0312742 A1 11/2013 Monsees et al.
2013/0312776 A1 11/2013 Newton
2013/0319435 A1 12/2013 Flick
2013/0319438 A1 12/2013 Liu
2013/0319439 A1 12/2013 Gorelick et al.
2013/0319440 A1 12/2013 Capuano
2013/0340750 A1 12/2013 Thorens et al.
2013/0340775 A1 12/2013 Juster et al.
2014/0060552 A1 3/2014 Cohen
2014/0076310 A1 3/2014 Newton
2014/0345631 A1 11/2014 Bowen et al.
2014/0366898 A1 12/2014 Monsees et al.
2015/0020824 A1 1/2015 Bowen et al.
2015/0128971 A1 5/2015 Verleur et al.
2015/0208729 A1 7/2015 Monsees et al.

FOREIGN PATENT DOCUMENTS

CA 2 752 255 8/2010
CN 1541577 11/2004
CN 2719043 8/2005
CN 200997909 1/2008
CN 101116542 2/2008
CN 101176805 5/2008
CN 201379072 1/2010
DE 10 2006 004 484 8/2007
DE 102006041042 3/2008
DE 20 2009 010 400 11/2009
EP 0 295 122 12/1988
EP 0 430 566 6/1991
EP 0 845 220 6/1998
EP 1 618 803 1/2006
EP 1989946 11/2008
EP 2 316 286 5/2011
EP 2 468 116 6/2012
EP 2 468 118 6/2012
GB 1444461 7/1976
GB 2469850 11/2010
JP 2005-198538 7/2005
RU 115629 5/2012
UA 67598 2/2012
WO WO 1986/02528 5/1986
WO WO 1997/48293 12/1997
WO WO 02/37990 5/2002
WO WO 2004/043175 5/2004
WO WO 2007/131449 11/2007
WO WO 2009/105919 9/2009
WO WO 2009/155734 12/2009
WO WO 2010/003480 1/2010
WO WO 2010/045670 4/2010
WO WO 2010/091593 8/2010
WO WO 2010/118644 10/2010
WO WO 2010/140937 12/2010
WO WO 2011/010334 1/2011
WO WO 2010/073122 7/2011
WO WO 2011/081558 7/2011
WO WO 2012/085919 6/2012

OTHER PUBLICATIONS

"(±)-nicotine," ChemSpider, [online], 2019, retrieved from the Internet, [retrieved Jan. 16, 2019], <URL: http://www.chemspider.com/Chemical-Structure.917.html>. (Year: 2019).
"(±)-1,2-propanediol," ChemSpider, [online], 2019, retrieved from the Internet, [retrieved Jan. 16, 2019], URL: http://www.chemspider.com/Chemical-Structure.13835224.html?rid=ae1c106a-376d-4104-9a7c-f0910a5b5b20&page_num=0>. (Year: 2019).

* cited by examiner

AEROSOL DELIVERY DEVICE

CROSS-REFERENCE TO RELATED APPLICATIONS

This application is a continuation of U.S. application Ser. No. 13/647,000, filed Oct. 8, 2012, which application is hereby incorporated by reference in its entirety in this application.

BACKGROUND OF THE DISCLOSURE

Field of the Disclosure

The present disclosure relates to aerosol delivery articles and uses thereof for yielding tobacco components or other materials in an inhalable form. The articles may be made or derived from tobacco or otherwise incorporate tobacco for human consumption.

Description of Related Art

Many smoking articles have been proposed through the years as improvements upon, or alternatives to, smoking products based upon combusting tobacco. Exemplary alternatives have included devices wherein a solid or liquid fuel is combusted to transfer heat to tobacco or wherein a chemical reaction is used to provide such heat source. Numerous references have proposed various smoking articles of a type that generate flavored vapor, visible aerosol, or a mixture of flavored vapor and visible aerosol. Some of those proposed types of smoking articles include tubular sections or longitudinally extending air passageways.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco.

General examples of alternative smoking articles are described in U.S. Pat. No. 3,258,015 to Ellis et al.; U.S. Pat. No. 3,356,094 to Ellis et al.; U.S. Pat. No. 3,516,417 to Moses; U.S. Pat. No. 4,347,855 to Lanzellotti et al.; U.S. Pat. No. 4,340,072 to Bolt et al.; U.S. Pat. No. 4,391,285 to Burnett et al.; U.S. Pat. No. 4,917,121 to Riehl et al.; U.S. Pat. No. 4,924,886 to Litzinger; and U.S. Pat. No. 5,060,676 to Hearn et al. Many of those types of smoking articles have employed a combustible fuel source that is burned to provide an aerosol and/or to heat an aerosol-forming material. See, for example, the background art cited in U.S. Pat. No. 4,714,082 to Banerjee et al. and U.S. Pat. No. 4,771,795 to White et al.; which are incorporated herein by reference in their entireties. See, also, for example, those types of smoking articles described in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,551,451 to Riggs et al.; U.S. Pat. No. 5,595,577 to Bensalem et al.; U.S. Pat. No. 5,819,751 to Barnes et al.; U.S. Pat. No. 6,089,857 to Matsuura et al.; U.S. Pat. No. 6,095,152 to Beven et al; U.S. Pat. No. 6,578,584 Beven; and U.S. Pat. No. 6,730,832 to Dominguez; which are incorporated herein by reference in their entireties. Furthermore, certain types of cigarettes that employ carbonaceous fuel elements have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). See also US Pat. Pub. No. 2005/0274390 to Banerjee et al., US Pat. Pub. No. 2007/0215167 to Crooks et al., US Pat. Pub. No. 2010/0058075 to Banerjee et al., and US Pat. Pub. No. 2012/0042885 to Stone et al., the disclosures of which are incorporated herein by reference in their entireties.

Certain proposed cigarette-shaped tobacco products purportedly employ tobacco in a form that is not intended to be burned to any significant degree. See, for example, U.S. Pat. No. 4,836,225 to Sudoh; U.S. Pat. No. 4,972,855 to Kuriyama et al.; and U.S. Pat. No. 5,293,883 to Edwards, which are incorporated herein by reference in their entireties. Yet other types of smoking articles, such as those types of smoking articles that generate flavored vapors by subjecting tobacco or processed tobaccos to heat produced from chemical or electrical heat sources, are described in U.S. Pat. No. 4,848,374 to Chard et al.; U.S. Pat. Nos. 4,947,874 and 4,947,875 to Brooks et al.; U.S. Pat. No. 5,060,671 to Counts et al.; U.S. Pat. No. 5,146,934 to Deevi et al.; U.S. Pat. No. 5,224,498 to Deevi; U.S. Pat. No. 5,285,798 to Banerjee et al.; U.S. Pat. No. 5,357,984 to Farrier et al.; U.S. Pat. No. 5,593,792 to Farrier et al.; U.S. Pat. No. 5,369,723 to Counts; U.S. Pat. No. 5,692,525 to Counts et al.; U.S. Pat. No. 5,865,185 to Collins et al.; U.S. Pat. No. 5,878,752 to Adams et al.; U.S. Pat. No. 5,880,439 to Deevi et al.; U.S. Pat. No. 5,915,387 to Baggett et al.; U.S. Pat. No. 5,934,289 to Watkins et al.; U.S. Pat. No. 6,033,623 to Deevi et al.; U.S. Pat. No. 6,053,176 to Adams et al.; U.S. Pat. No. 6,164,287 to White; U.S. Pat. No. 6,289,898 to Fournier et al.; U.S. Pat. No. 6,615,840 to Fournier et al.; U.S. Pat. Pub. No. 2003/0131859 to Li et al.; U.S. Pat. Pub. No. 2005/0016549 to Banerjee et al.; and U.S. Pat. Pub. No. 2006/0185687 to Hearn et al., each of which is incorporated herein by reference in its entirety.

Certain attempts have been made to deliver vapors, sprays or aerosols, such as those possessing or incorporating flavors and/or nicotine. See, for example, the types of devices set forth in U.S. Pat. No. 4,190,046 to Virag; U.S. Pat. No. 4,284,089 to Ray; U.S. Pat. No. 4,635,651 to Jacobs; U.S. Pat. No. 4,735,217 to Gerth et al.; U.S. Pat. No. 4,800,903 to Ray et al.; U.S. Pat. No. 5,388,574 to Ingebrethsen et al.; U.S. Pat. No. 5,799,663 to Gross et al.; U.S. Pat. No. 6,532,965 to Abhulimen et al.; and U.S. Pat. No. 6,598,607 to Adiga et al; and EP 1,618,803 to Hon; which are incorporated herein by reference in their entireties. See also, U.S. Pat. No. 7,117,867 to Cox et al. and the devices set forth on the website, www.e-cig.com, which are incorporated herein by reference in their entireties.

Still further representative cigarettes or smoking articles that have been described and, in some instances, been made commercially available include those described in U.S. Pat. No. 4,922,901 to Brooks et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; US Pat. Pub. No. 2009/0095311 to Hon; US Pat. Pub. Nos. 2006/0196518, 2009/0126745, and 2009/0188490 to Hon; US Pat. Pub. No. 2009/0272379 to Thorens et al.; US Pat. Pub. Nos. 2009/0260641 and 2009/0260642 to Monsees et al.; US Pat. Pub. Nos. 2008/0149118 and 2010/0024834 to Oglesby et al.; US Pat. Pub. No. 2010/0307518 to Wang; and WO 2010/091593 to Hon. Still further examples include electronic cigarette products commercially available under the names ACCORD®; HEATBAR™; HYBRID CIGARETTE®, VEGAS™; E-GAR™; C-GAR™; E-MYSTICK™; IOLITE® Vaporizer, GREEN SMOKE®, BLU™ Cigs, WHITE CLOUD® Cirrus, V2CIGS™ SOUTH BEACH SMOKE™, SMOKETIP®, SMOKE STIK®, NJOY®, LUCI®, Royal Blues, SMART SMOKER®, SMOKE ASSIST®, Knight Sticks, GAMUCCI®, InnoVapor, SMOKING EVERYWHERE®, Crown 7, CHOICE™ NO. 7™, VAPORKING®, EPUFFER®, LOGIC™ ecig, VAPOR4LIFE®, NICOTEK®, METRO®, VUSE®, and PREMIUM™.

Smoking articles that employ tobacco substitute materials and smoking articles that employ sources of heat other than burning tobacco cut filler to produce tobacco-flavored vapors or tobacco-flavored visible aerosols have not received widespread commercial success. Articles that produce the taste and sensation of smoking by electrically heating tobacco particularly have suffered from inconsistent release of flavors or other inhalable materials. Electrically heated smoking devices have further been limited in many instances to the requirement of an external heating device that was inconvenient and that detracted from the smoking experience. Accordingly, it can be desirable to provide a smoking article that can provide the sensations of cigarette, cigar, or pipe smoking, that does so without combusting tobacco, that does so without the need of a combustion heat source, and that does so without necessarily delivering considerable quantities of incomplete combustion and pyrolysis products.

BRIEF SUMMARY OF THE DISCLOSURE

The above and other needs are met by the present disclosure which, in one aspect, provides a smoking article including a control body portion having a control body engagement end, wherein the control body portion also has a first control component therein. A cartridge body portion including a cartridge body engagement end configured to removably engage the control body engagement end of the control body portion. The cartridge body portion further includes a consumable arrangement comprising at least an aerosol precursor composition and at least one heating element operably engaged therewith, and a second control component. At least the consumable arrangement is configured to be in communication with the first control component upon engagement between the cartridge body and control body portions.

Another aspect of the present disclosure provides a method of forming a smoking article. Such a method may comprise removably engaging a control body engagement end of a control body portion with a cartridge body engagement end of a cartridge body portion, wherein the control body portion includes a first control component therein and the cartridge body portion includes a consumable arrangement comprising at least an aerosol precursor composition and at least one heating element operably engaged therewith, and a second control component, so as to establish communication between the consumable arrangement and the first control component upon engagement between the cartridge body and control body portions.

Aspects of the present disclosure thus address the identified needs and provide other advantages as detailed herein.

BRIEF DESCRIPTION OF THE SEVERAL VIEWS OF THE DRAWING(S)

Having thus described the disclosure in the foregoing general terms, reference will now be made to the accompanying drawings, which are not necessarily drawn to scale, and wherein:

DETAILED DESCRIPTION OF THE DISCLOSURE

Figure 1:
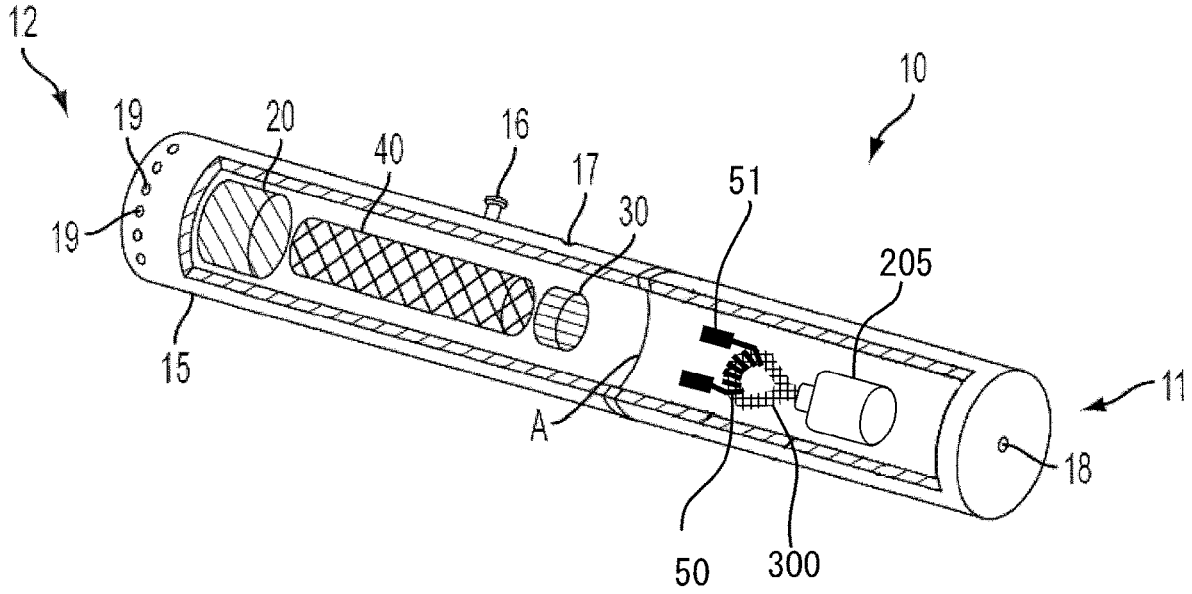
FIG. 1 is a perspective view of an example embodiment of a smoking article according to the disclosure, wherein a portion of an outer shell of the article is cut away to reveal the interior components thereof.

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides articles that use electrical energy to heat a material (preferably without combusting the material to any significant degree) to form an inhalable substance, the articles being sufficiently compact to be considered "hand-held" devices. In certain embodiments, the articles can particularly be characterized as smoking articles. As used herein, the term is intended to mean an article that provides the taste and/or the sensation (e.g., hand-feel or mouth-feel) of smoking a cigarette, cigar, or pipe without substantial combustion of any component of the article. The term smoking article does not necessarily indicate that, in operation, the article produces smoke in the sense of the by-product of combustion or pyrolysis. Rather, smoking relates to the physical action of an individual in using the article—e.g., holding the article, drawing on one end of the article, and inhaling from the article. In further embodiments, the inventive articles can be characterized as being vapor-producing articles, aerosolization articles, or medicament delivery articles. Thus, the articles can be arranged so as to provide one or more substances in an inhalable state. In other embodiments, the inhalable substance can be substantially in the form of a vapor (i.e., a substance that is in the gas phase at a temperature lower than its critical point). In other embodiments, the inhalable substance can be in the form of an aerosol (i.e., a suspension of fine solid particles or liquid droplets in a gas). The physical form of the inhalable substance is not necessarily limited by the nature of the inventive articles but rather may depend upon the nature of the medium and the inhalable substance itself as to whether it exists in a vapor state or an aerosol state. In some embodiments, the terms may be interchangeable. Thus, for simplicity, the terms as used to describe the disclosure are understood to be interchangeable unless stated otherwise.

In one aspect, the present disclosure provides a smoking article. The smoking article generally can include a number of components provided within an elongated body, which can be a single, unitary shell or which can be formed of two or more separable pieces. For example, a smoking article according to one embodiment can comprise a shell (i.e., the elongated body) that can be substantially tubular in shape, such as resembling the shape of a conventional cigarette or cigar. Within the shell can reside all of the components of the smoking article. In other embodiments, a smoking article can comprise two shells that are joined and are separable. For example, a control body can comprise a shell containing one or more reusable components and having an end that removably attaches to a cartridge. The cartridge can comprise a shell containing one or more disposable components and having an end that removably attaches to the control body. More specific arrangements of components within the single shell or within the separable control body and cartridge are evident in light of the further disclosure provided herein.

Smoking articles useful according to the disclosure particularly can comprise some combination of a power source (i.e., an electrical power source), one or more control components (e.g., to control/actuate/regulate flow of power from the power source to one or more further components of the article), a heater component, and an aerosol precursor component. The smoking article further can include a defined air flow path through the article such that aerosol generated by the article can be withdrawn therefrom by a user drawing on the article. Alignment of the components within the article can vary. In specific embodiments, the aerosol precursor component can be located near an end of the article that is proximal to the mouth of a user so as to maximize aerosol delivery to the user. Other configurations, however, are not excluded. Generally, the heater component can be positioned sufficiently near that aerosol precursor component so that heat from the heater component can volatilize the aerosol precursor (as well as one or more flavorants, medicaments, or the like that may likewise be provided for delivery to a user) and form an aerosol for delivery to the user. When the heating member heats the aerosol precursor component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof.

A smoking article according to the disclosure generally can include a battery or other electrical power source to provide current flow sufficient to provide various functionalities to the article, such as resistive heating, powering of indicators, and the like. The power source for the inventive smoking article can take on various embodiments. Preferably, the power source is able to deliver sufficient power to rapidly heat the heating member to provide for aerosol formation and power the article through use for the desired duration of time. The power source preferably is sized to fit conveniently within the article. Examples of useful power sources include lithium ion batteries that preferably are rechargeable (e.g., a rechargeable lithium-manganese dioxide battery). In particular, lithium polymer batteries can be used as such batteries can provide increased safety. Other types of batteries—e.g., N50-AAA CADNICA nickel-cadmium cells—may also be used. Even further examples of batteries that can be used according to the disclosure are described in US Pub. App. No. 2010/0028766, the disclosure of which is incorporated herein by reference in its entirety. Thin film batteries may be used in certain embodiments of the disclosure. Any of these batteries or combinations thereof can be used in the power source, but rechargeable batteries are preferred because of cost and disposal considerations associated with disposable batteries. In embodiments wherein disposable batteries are provided, smoking article can include access for removal and replacement of the battery. Alternatively, in embodiments where rechargeable batteries are used, the smoking article can comprise charging contacts, for interaction with corresponding contacts in a conventional recharging unit deriving power from a standard 120-volt AC wall outlet, or other sources such as an automobile electrical system or a separate portable power supply, including USB connections. Means for recharging the battery can be provided in a portable charging case that can include, for example, a relatively larger battery unit that can provide multiple charges for the relatively smaller batteries present in the smoking article. The article further can include components for providing a non-contact inductive recharging system such that the article can be charged without being physically connected to an external power source. Thus, the article can include components to facilitate transfer of energy from an electromagnetic field to the rechargeable battery within the article.

In further embodiments, the power source also can comprise one or more capacitors. Capacitors are capable of discharging more quickly than batteries and can be charged between puffs, allowing the battery to discharge into the capacitor at a lower rate than if it were used to power the heating member directly. For example, a supercapacitor—i.e., an electric double-layer capacitor (EDLC)—may be used separate from or in combination with a battery. When used alone, the supercapacitor may be recharged before each use of the article. Thus, the disclosure also may include a charger component that can be attached to the smoking article between uses to replenish the supercapacitor.

The smoking article can further include a variety of power management software, hardware, and/or other electronic control components. For example, such software, hardware, and/or electronic controls can include carrying out charging of the battery, detecting the battery charge and discharge status, performing power save operations, preventing unintentional or over-discharge of the battery, or the like.

A "controller" or "control component" according to the present disclosure can encompass a variety of elements useful in the present smoking article. Moreover, a smoking article according to the disclosure can include one, two, or even more control components that can be combined into a unitary element or that can be present at separate locations within the smoking article, and individual control components can be utilized for carrying out different control aspects. For example, a smoking article can include a control component that is integral to or otherwise combined with a battery so as to control power discharge from the battery. The smoking article separately can include a control component that controls other aspects of the article. Alternatively, a single controller may be provided that carries out multiple control aspects or all control aspects of the article. Likewise, a sensor (e.g., a puff sensor) used in the article can include a control component that controls the actuation of power discharge from the power source in response to a stimulus. The smoking article separately can include a control component that controls other aspects of the article. Alternatively, a single controller may be provided in or otherwise associated with the sensor for carrying out multiple control aspects or all control aspects of the article. Thus, it can be seen that a variety of combinations of controllers may be combined in the present smoking article to provide the desired level of control of all aspects of the device.

The smoking article also can comprise one or more controller components useful for controlling flow of electrical energy from the power source to further components of the article, such as to a resistive heating element. Specifically, the article can comprise a control component that actuates current flow from the power source, such as to the resistive heating element. For example, in some embodiments, the article can include a pushbutton that can be linked to a control circuit for manual control of power flow, wherein a consumer can use the pushbutton to turn on the article and/or to actuate current flow into the resistive heating element. Multiple buttons can be provided for manual performance of powering the article on and off, and for activating heating for aerosol generation. One or more pushbuttons present can be substantially flush with an outer surface of the smoking article.

Instead of (or in addition to) the pushbutton, the inventive article can include one or more control components responsive to the consumer's drawing on the article (i.e., puff-actuated heating). For example, the article may include a switch that is sensitive either to pressure changes or air flow changes as the consumer draws on the article (i.e., a puff-actuated switch). Other suitable current actuation/deactuation mechanisms may include a temperature actuated on/off switch or a lip pressure actuated switch. An exemplary mechanism that can provide such puff-actuation capability includes a Model 163PC01D36 silicon sensor, manufactured by the MicroSwitch division of Honeywell, Inc., Freeport, Ill. With such sensor, the resistive heating element can be activated rapidly by a change in pressure when the consumer draws on the article. In addition, flow sensing devices, such as those using hot-wire anemometry principles, may be used to cause the energizing of the resistive heating element sufficiently rapidly after sensing a change in air flow. A further puff actuated switch that may be used is a pressure differential switch, such as Model No. MPL-502-V, range A, from Micro Pneumatic Logic, Inc., Ft. Lauderdale, Fla. Another suitable puff actuated mechanism is a sensitive pressure transducer (e.g., equipped with an amplifier or gain stage) which is in turn coupled with a comparator for detecting a predetermined threshold pressure. Yet another suitable puff actuated mechanism is a vane which is deflected by airflow, the motion of which vane is detected by a movement sensing means. Yet another suitable actuation mechanism is a piezoelectric switch. Also useful is a suitably connected Honeywell MicroSwitch Microbridge Airflow Sensor, Part No. AWM 2100V from MicroSwitch Division of Honeywell, Inc., Freeport, Ill. Further examples of demand-operated electrical switches that may be employed in a heating circuit according to the present disclosure are described in U.S. Pat. No. 4,735,217 to Gerth et al., which is incorporated herein by reference in its entirety. Other suitable differential switches, analog pressure sensors, flow rate sensors, or the like, will be apparent to the skilled artisan with the knowledge of the present disclosure. A pressure-sensing tube or other passage providing fluid connection between the puff actuated switch and an air flow passage within the smoking article can be included so that pressure changes during draw are readily identified by the switch. Further description of current regulating circuits and other control components, including microcontrollers, that can be useful in the present smoking article are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., and U.S. Pat. No. 7,040,314 to Nguyen et al., all of which are incorporated herein by reference in their entireties.

Capacitive sensing components in particular can be incorporated into the device in a variety of manners to allow for diverse types of "power-up" and/or "power-down" for one or more components of the device. Capacitive sensing can include the use of any sensor incorporating technology based on capacitive coupling including, but not limited to, sensors that detect and/or measure proximity, position or displacement, humidity, fluid level, pressure, or acceleration. Capacitive sensing can arise from electronic components providing for surface capacitance, projected capacitance, mutual capacitance, or self capacitance. Capacitive sensors generally can detect anything that is conductive or has a dielectric different than that of air. Capacitive sensors, for example, can replace mechanical buttons (i.e., the pushbutton referenced above) with capacitive alternatives. Thus, one specific application of capacitive sensing according to the disclosure is a touch capacitive sensor. For example, a touch pad can be present on the smoking article that allows the user to input a variety of commands Most basically, the touch pad can provide for powering the heating element much in the same manner as a push button, as already described above. In other embodiments, capacitive sensing can be applied near the mouth end of the smoking article such that the pressure of the lips on the smoking article to draw on the article can signal the device to provide power to the heating element. In addition to touch capacitance sensors, motion capacitance sensors, liquid capacitance sensors, and accelerometers can be utilized according to the disclosure to illicit a variety of response from the smoking article. Further, photoelectric sensors also can be incorporated into the inventive smoking article.

Sensors utilized in the present articles can expressly signal for power flow to the heating element so as to heat the substrate including the aerosol precursor material and form a vapor or aerosol for inhalation by a user. Sensors also can provide further functions. For example, a "wake-up" sensor can be included. Other sensing methods providing similar function likewise can be utilized according to the disclosure.

When the consumer draws on the mouth end of the smoking article, the current actuation means can permit unrestricted or uninterrupted flow of current through the resistive heating member to generate heat rapidly. Because of the rapid heating, it can be useful to include current regulating components to (i) regulate current flow through the heating member to control heating of the resistive element and the temperature experienced thereby, and (ii) prevent overheating and degradation of the substrate or other component carrying the aerosol precursor material and/or other flavors or inhalable materials.

The current regulating circuit particularly may be time based. Specifically, such a circuit includes a means for permitting uninterrupted current flow through the heating element for an initial time period during draw, and a timer means for subsequently regulating current flow until draw is completed. For example, the subsequent regulation can include the rapid on-off switching of current flow (e.g., on the order of about every 1 to 50 milliseconds) to maintain the heating element within the desired temperature range. Further, regulation may comprise simply allowing uninterrupted current flow until the desired temperature is achieved then turning off the current flow completely. The heating member may be reactivated by the consumer initiating another puff on the article (or manually actuating the push-button, depending upon the specific switch embodiment employed for activating the heater). Alternatively, the subsequent regulation can involve the modulation of current flow through the heating element to maintain the heating element within a desired temperature range. In some embodiments, so as to release the desired dosing of the inhalable substance, the heating member may be energized for a duration of about 0.2 second to about 5.0 seconds, about 0.3 second to about 4.5 seconds, about 0.5 second to about 4.0 seconds, about 0.5 second to about 3.5 seconds, or about 0.6 second to about 3.0 seconds. One exemplary time-based current regulating circuit can include a transistor, a timer, a comparator, and a capacitor. Suitable transistors, timers, comparators, and capacitors are commercially available and will be apparent to the skilled artisan. Exemplary timers are those available from NEC Electronics as C-1555C and from General Electric Intersil, Inc. as ICM7555, as well as various other sizes and configurations of so-called "555 Timers". An exemplary comparator is available from National Semiconductor as LM311. Further description of such time-based current regulating circuits and other control components that can be useful in the present smoking article are provided in U.S. Pat. Nos. 4,922,901, 4,947,874, and 4,947,875, all to Brooks et al., all of which are incorporated herein by reference in their entireties.

The control components particularly can be configured to closely control the amount of heat provided to the resistive heating element. In some embodiments, the current regulating component can function to stop current flow to the resistive heating element once a defined temperature has been achieved. Such defined temperature can be in a range that is substantially high enough to volatilize the aerosol precursor material and any further inhalable substances and provide an amount of aerosol equivalent to a typical puff on a conventional cigarette, as otherwise discussed herein. While the heat needed to volatilize the aerosol precursor material in a sufficient volume to provide a desired volume for a single puff can vary, it can be particularly useful for the heating member to heat to a temperature of about 120° C. or greater, about 130° C. or greater, about 140° C. or greater, or about 160° C. In some embodiments, in order to volatilize an appropriate amount of the aerosol precursor material, the heating temperature may be about 180° C. or greater, about 200° C. or greater, about 300° C. or greater, or about 350° C. or greater. In further embodiments, the defined temperature for aerosol formation can be about 120° C. to about 350° C., about 140° C. to about 300° C., or about 150° C. to about 250° C. The temperature and time of heating can be controlled by one or more components contained in the control housing. The current regulating component likewise can cycle the current to the resistive heating element off and on once a defined temperature has been achieved so as to maintain the defined temperature for a defined period of time.

Still further, the current regulating component can cycle the current to the resistive heating element off and on to maintain a first temperature that is below an aerosol forming temperature and then allow an increased current flow in response to a current actuation control component so as to achieve a second temperature that is greater than the first temperature and that is an aerosol forming temperature. Such controlling can improve the response time of the article for aerosol formation such that aerosol formation begins almost instantaneously upon initiation of a puff by a consumer. In some embodiments, the first temperature (which can be characterized as a standby temperature) can be only slightly less than the aerosol forming temperature defined above. Specifically, the standby temperature can be about 50° C. to about 150° C., about 70° C. to about 140° C., about 80° C. to about 120° C., or about 90° C. to about 110° C.

In addition to the above control elements, the smoking article also may comprise one or more indicators. Such indicators may be lights (e.g., light emitting diodes) that can provide indication of multiple aspects of use of the inventive article. Further, LED indicators may be positioned at the distal end of the smoking article to simulate color changes seen when a conventional cigarette is lit and drawn on by a user. Other indices of operation also are encompassed. For example, visual indicators also may include changes in light color or intensity to show progression of the smoking experience. Tactile indicators and sound indicators similarly are encompassed by the disclosure. Moreover, combinations of such indicators also may be used in a single article.

A smoking article according to the disclosure further can comprise a heating member that heats an aerosol precursor component to produce an aerosol for inhalation by a user. In various embodiments, the heating member can be formed of a material that provides resistive heating when an electrical current is applied thereto. Preferably, the resistive heating element exhibits an electrical resistance making the resistive heating element useful for providing a sufficient quantity of heat when electrical current flows therethrough. Interaction of the heating member with the aerosol precursor component/composition may be through, for example, heat conduction, heat radiation, and/or heat convection.

Electrically conductive materials useful as resistive heating elements can be those having low mass, low density, and moderate resistivity and that are thermally stable at the temperatures experienced during use. Useful heating elements heat and cool rapidly, and thus provide for the efficient use of energy. Rapid heating of the element can be beneficial to provide almost immediate volatilization of an aerosol precursor material in proximity thereto. Rapid cooling (i.e., to a temperature below the volatilization temperature of the aerosol precursor component/composition/material) prevents substantial volatilization (and hence waste) of the aerosol precursor material during periods when aerosol formation is not desired. Such heating elements also permit relatively precise control of the temperature range experienced by the aerosol precursor material, especially when time based current control is employed. Useful electrically conductive materials preferably are chemically non-reactive with the materials being heated (e.g., aerosol precursor materials and other inhalable substance materials) so as not to adversely affect the flavor or content of the aerosol or vapor that is produced. Exemplary, non-limiting, materials that can be used as the electrically conductive material include carbon, graphite, carbon/graphite composites, metals, metallic and non-metallic carbides, nitrides, silicides, inter-metallic compounds, cermets, metal alloys, and metal foils. In particular, refractory materials may be useful. Various, different materials can be mixed to achieve the desired properties of resistivity, mass, and thermal conductivity. In specific embodiments, metals that can be utilized include, for example, nickel, chromium, alloys of nickel and chromium (e.g., nichrome), and steel. Materials that can be useful for providing resistive heating are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

The resistive heating element can be provided in a variety forms, such as in the form of a foil, a foam, discs, spirals, fibers, wires, films, yarns, strips, ribbons, or cylinders, as well as irregular shapes of varying dimensions. In some embodiments, a resistive heating element according to the present disclosure can be a conductive substrate, such as described in co-pending U.S. patent application Ser. No. 13/432,406, filed Mar. 28, 2012, the disclosure of which is incorporated herein by reference in its entirety. The resistive heating element also may be present as part of a microheater component, such as described in co-pending U.S. patent application Ser. No. 13/602,871, filed Sep. 4, 2012, the disclosure of which is incorporated herein by reference in its entirety.

Beneficially, the resistive heating element can be provided in a form that enables the heating element to be positioned in intimate contact with or in close proximity to the aerosol precursor material (i.e. to provide heat to the aerosol precursor material through, for example, conduction, radiation, or convection). In other embodiments, the resistive heating element can be provided in a form such that the aerosol precursor material can be delivered to the resistive heating element for aerosolization. Such delivery can take on a variety of embodiments, such as wicking of the aerosol precursor to the resistive heating element and flowing the aerosol precursor to the resistive heating element, such as through a capillary, which may include valve flow regulation. As such, the aerosol precursor material may be provided in liquid form in one or more reservoirs positioned sufficiently away from the resistive heating element to prevent premature aerosolization, but positioned sufficiently close to the resistive heating element to facilitate transport of the aerosol precursor material, in the desired amount, to the resistive heating element for aerosolization.

In certain embodiments, a smoking article according to the present disclosure can include tobacco, a tobacco component, or a tobacco-derived material (i.e., a material that is found naturally in tobacco that may be isolated directly from the tobacco or synthetically prepared). The tobacco that is employed can include, or can be derived from, tobaccos such as flue-cured tobacco, burley tobacco, Oriental tobacco, Maryland tobacco, dark tobacco, dark-fired tobacco and Rustica tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al., U.S. Pat. No. 7,011,096 to Li et al.; U.S. Pat. No. 7,017,585 to Li et al.; U.S. Pat. No. 7,025,066 to Lawson et al.; US Pat. App. Pub. No. 2004/0255965 to Perfetti et al.; PCT Pub. WO 02/37990 to Bereman; and Bombick et al., *Fund. Appl. Toxicol.,* 39, p. 11-17 (1997); the disclosures of which are incorporated herein by reference in their entireties.

The tobacco that is incorporated within the smoking article can be employed in various forms; and combinations of various forms of tobacco can be employed, or different forms of tobacco can be employed at different locations within the smoking article. For example, the tobacco can be employed in the form of a tobacco extract. See, for example, U.S. Pat. No. 7,647,932 to Cantrell et al.; U.S. Pat. No. 8,079,371 to Robinson et al.; and U.S. Pat. Pub. No. 2007/0215167 to Crooks et al., the disclosures of which are incorporated herein by reference in their entireties.

The smoking article can incorporate tobacco additives of the type that are traditionally used for the manufacture of tobacco products. Those additives can include the types of materials used to enhance the flavor and aroma of tobaccos used for the production of cigars, cigarettes, pipes, and the like. For example, those additives can include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials include water, sugars and syrups (e.g., sucrose, glucose and high fructose corn syrup), humectants (e.g. glycerin or propylene glycol), and flavoring agents (e.g., cocoa and licorice). Those added components also include top dressing materials (e.g., flavoring materials, such as menthol). See, for example, U.S. Pat. No. 4,449,541 to Mays et al., the disclosure of which is incorporated herein by reference in its entirety. Further materials that can be added include those disclosed in U.S. Pat. No. 4,830,028 to Lawson et al. and US Pat. Pub. No. 2008/0245377 to Marshall et al., the disclosures of which are incorporated herein by reference in their entireties.

Various manners and methods for incorporating tobacco into smoking articles, and particularly smoking articles that are designed so as to not purposefully burn virtually all of the tobacco within those smoking articles, are set forth in U.S. Pat. No. 4,947,874 to Brooks et al.; U.S. Pat. No. 7,647,932 to Cantrell et al.; U.S. Pat. No. 8,079,371 to Robinson et al.; US Pat. App. Pub. No. 2005/0016549 to Banerjee et al.; and US Pat. App. Pub. No. 2007/0215167 to Crooks et al.; the disclosures of which are incorporated herein by reference in their entireties.

Further tobacco materials, such as a tobacco aroma oil, a tobacco essence, a spray dried tobacco extract, a freeze dried tobacco extract, tobacco dust, or the like may be included in the vapor precursor or aerosol precursor composition. As used herein, the term "tobacco extract" means components separated from, removed from, or derived from, tobacco using tobacco extraction processing conditions and techniques. Purified extracts of tobacco or other botanicals specifically can be used. Typically, tobacco extracts are obtained using solvents, such as solvents having an aqueous nature (e.g., water) or organic solvents (e.g., alcohols, such as ethanol or alkanes, such as hexane). As such, extracted tobacco components are removed from tobacco and separated from the unextracted tobacco components; and for extracted tobacco components that are present within a solvent, (i) the solvent can be removed from the extracted tobacco components, or (ii) the mixture of extracted tobacco components and solvent can be used as such. Exemplary types of tobacco extracts, tobacco essences, solvents, tobacco extraction processing conditions and techniques, and tobacco extract collection and isolation procedures, are set forth in Australia Pat. No. 276,250 to Schachner; U.S. Pat. No. 2,805,669 to Meriro; U.S. Pat. No. 3,316,919 to Green et al.; U.S. Pat. No. 3,398,754 to Tughan; U.S. Pat. No. 3,424,171 to Rooker; U.S. Pat. No. 3,476,118 to Luttich; U.S. Pat. No. 4,150,677 to Osborne; U.S. Pat. No. 4,131,117 to Kite; U.S. Pat. No. 4,506,682 to Muller; U.S. Pat. No. 4,986,286 to Roberts et al.; U.S. Pat. No. 5,005,593 to Fagg; U.S. Pat. No. 5,065,775 to Fagg; U.S. Pat. No. 5,060,669 to White et al.; U.S. Pat. No. 5,074,319 to White et al.; U.S. Pat. No. 5,099,862 to White et al.; U.S. Pat. No. 5,121,757 to White et al.; U.S. Pat. No. 5,131,415 to Munoz et al.; U.S. Pat. No. 5,230,354 to Smith et al.; U.S. Pat. No. 5,235,992 to Sensabaugh; U.S. Pat. No. 5,243,999 to Smith; U.S. Pat. No. 5,301,694 to Raymond; U.S. Pat. No. 5,318,050 to Gonzalez-Parra et al.; U.S. Pat. No. 5,435,325 to Clapp et al.; and U.S. Pat. No. 5,445,169 to Brinkley et al.; the disclosures of which are incorporated herein by reference in their entireties.

The aerosol precursor or vapor precursor material can comprise one or more different components. For example, the aerosol precursor can include a polyhydric alcohol (e.g., glycerin, propylene glycol, or a mixture thereof). Representative types of further aerosol precursor materials are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some embodiments, an aerosol precursor composition can produce a visible aerosol upon the application of sufficient heat thereto (and cooling with air, if necessary), and the aerosol precursor composition can produce an aerosol that can be considered to be "smoke-like." In other embodiments, the aerosol precursor composition can produce an aerosol that can be substantially non-visible but can be recognized as present by other characteristics, such as flavor or texture. Thus, the nature of the produced aerosol can vary depending upon the specific components of the aerosol precursor composition. The aerosol precursor composition can be chemically simple relative to the chemical nature of the smoke produced by burning tobacco.

Aerosol precursor materials can be combined with other liquid materials. For example, aerosol precursor material formulations can incorporate mixtures of glycerin and water, or mixtures of propylene glycol and water, or mixtures of propylene glycol and glycerin, or mixtures of propylene glycol, glycerin, and water. Exemplary aerosol precursor materials also include those types of materials incorporated within devices available through Atlanta Imports Inc., Acworth, Ga., USA., as an electronic cigar having the brand name E-CIG, which can be employed using associated Smoking Cartridges Type—C1a, C2a, C3a, C4a, C1b, C2b, C3b and C4b; and as Ruyan Atomizing Electronic Pipe and Ruyan Atomizing Electronic Cigarette from Ruyan SBT Technology and Development Co., Ltd., Beijing, China.

The smoking article further can comprise one or more flavors, medicaments, or other inhalable materials. For example, liquid nicotine can be used. Such further materials may be combined with the aerosol precursor or vapor precursor material. Thus, the aerosol precursor or vapor precursor material may be described as comprising an inhalable substance in addition to the aerosol. Such inhalable substance can include flavors, medicaments, and other materials as discussed herein. Particularly, an inhalable substance delivered using a smoking article according to the present disclosure can comprise a tobacco component or a tobacco-derived material. For example, the aerosol precursor material can be in a slurry with tobacco or a tobacco component, or in solution with a tobacco-derived material. Alternately, the flavor, medicament, or other inhalable material can be provided separate from the aerosol precursor—e.g., in a reservoir. As such, defined aliquots of the flavor, medicament, or other inhalable material may be separately or simultaneously delivered to the resistive heating element to release the flavor, medicament, or other inhalable material into an air stream to be inhaled by a user along with the aerosol precursor or vapor precursor material. Alternatively, the flavor, medicament, or other inhalable material may be provided in a separate portion of the smoking article or a component thereof. In specific embodiments, the flavor, medicament, or other inhalable material can be deposited on a substrate (e.g., a paper or other porous material) that is located in proximity to the resistive heating element. The proximity preferably is sufficient such that heating of the resistive heating element provides heat to the substrate sufficient to volatilize and release the flavor, medicament, or other inhalable material from the substrate.

A wide variety of types of flavoring agents, or materials that alter the sensory or organoleptic character or nature of the mainstream aerosol of the smoking article, can be employed. Such flavoring agents can be provided from sources other than tobacco, can be natural or artificial in nature, and can be employed as concentrates or flavor packages. Of particular interest are flavoring agents that are applied to, or incorporated within, those regions of the smoking article where aerosol is generated. Again, such agents can be supplied directly to the resistive heating element or may be provided on a substrate as already noted above. Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, also can be employed. Flavoring agents also can include acidic or basic characteristics (e.g., organic acids, such as levulinic acid, succinic acid, and pyruvic acid). The flavoring agents can be combined with the aerosol-generating material if desired. Exemplary plant-derived compositions that may be used are disclosed in U.S. application Ser. No. 12/971,746 to Dube et al. and U.S. application Ser. No. 13/015,744 to Dube et al., the disclosures of which are incorporated herein by reference in their entireties. The selection of such further components can vary based upon factors such as the sensory characteristics that are desired for the present article, and the present disclosure is intended to encompass any such further components that may be readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. Any of the materials, such as flavorings, casings, and the like that can be useful in combination with a tobacco material to affect sensory properties thereof, including organoleptic properties, such as already described herein, may be combined with the aerosol precursor material. Organic acids particularly may be incorporated into the aerosol precursor composition to affect the flavor, sensation, or organoleptic properties of medicaments, such as nicotine, that may be combined with the aerosol precursor composition. For example, organic acids, such as levulinic acid, lactic acid, and pyruvic acid, may be included in the aerosol precursor composition with nicotine in amounts up to being equimolar (based on total organic acid content) with the nicotine. Any combination of organic acids can be used. For example, the aerosol precursor composition can include about 0.1 to about 0.5 moles of levulinic acid per one mole of nicotine, about 0.1 to about 0.5 moles of pyruvic acid per one mole of nicotine, about 0.1 to about 0.5 moles of lactic acid per one mole of nicotine, or combinations thereof, up to a concentration wherein the total amount of organic acid present is equimolar to the total amount of nicotine present in the aerosol precursor composition.

The aerosol precursor material may take on a variety of conformations based upon the various amounts of materials utilized therein. For example, a useful aerosol precursor material may comprise up to about 98% by weight up to about 95% by weight, or up to about 90% by weight of a polyol. This total amount can be split in any combination between two or more different polyols. For example, one polyol can comprise about 50% to about 90%, about 60% to about 90%, or about 75% to about 90% by weight of the aerosol precursor material, and a second polyol can comprise about 2% to about 45%, about 2% to about 25%, or about 2% to about 10% by weight of the aerosol precursor material. A useful aerosol precursor material also can comprise up to about 25% by weight, about 20% by weight or about 15% by weight water—particularly about 2% to about 25%, about 5% to about 20%, or about 7% to about 15% by weight water. Flavors and the like (which can include medicaments, such as nicotine) can comprise up to about 10%, up to about 8%, or up to about 5% by weight of the aerosol precursor material.

As a non-limiting example, an aerosol precursor material according to the disclosure can comprise glycerol, propylene glycol, water, nicotine, and one or more flavors. Specifically, the glycerol can be present in an amount of about 70% to about 90% by weight, about 70% to about 85% by weight, or about 75% to about 85% by weight, the propylene glycol can be present in an amount of about 1% to about 10% by weight, about 1% to about 8% by weight, or about 2% to about 6% by weight, the water can be present in an amount of about 10% to about 20% by weight, about 10% to about 18% by weight, or about 12% to about 16% by weight, the nicotine can be present in an amount of about 0.1% to about 5% by weight, about 0.5% to about 4% by weight, or about 1% to about 3% by weight, and the flavors can be present in an amount of up to about 5% by weight, up to about 3% by weight, or up to about 1% by weight, all amounts being based on the total weight of the aerosol precursor material. One specific, non-limiting example of an aerosol precursor material comprises about 75% to about 80% by weight glycerol, about 13% to about 15% by weight water, about 4% to about 6% by weight propylene glycol, about 2% to about 3% by weight nicotine, and about 0.1% to about 0.5% by weight flavors. The nicotine, for example, can be a high nicotine content tobacco extract.

In embodiments of the aerosol precursor material that contain a tobacco extract, including pharmaceutical grade nicotine derived from tobacco, it is advantageous for the tobacco extract to be characterized as substantially free of compounds collectively known as Hoffmann analytes, including, for example, tobacco-specific nitrosamines (TSNAs), including N'-nitrosonornicotine (NNN), (4-methylnitrosamino)-1-(3-pyridyl)-1-butanone (NNK), N'-nitrosoanatabine (NAT), and N'-nitrosoanabasine (NAB); polyaromatic hydrocarbons (PAHs), including benz[a]anthracene, benzo[a]pyrene, benzo[b]fluoranthene, benzo[k]fluoranthene, chrysene, dibenz[a,h]anthracene, and indeno[1,2,3-cd]pyrene, and the like. In certain embodiments, the aerosol precursor material can be characterized as completely free of any Hoffmann analytes, including TSNAs and PAHs. Embodiments of the aerosol precursor material may have TSNA levels (or other Hoffmann analyte levels) in the range of less than about 5 ppm, less than about 3 ppm, less than about 1 ppm, or less than about 0.1 ppm, or even below any detectable limit. Certain extraction processes or treatment processes can be used to achieve reductions in Hoffmann analyte concentration. For example, a tobacco extract can be brought into contact with an imprinted polymer or non-imprinted polymer such as described, for example, in US Pat. Pub. Nos. 2007/0186940 to Bhattacharyya et al; 2011/0041859 to Rees et al.; and 2011/0159160 to Jonsson et al; and U.S. patent application Ser. No. 13/111,330 to Byrd et al., filed May 19, 2011, all of which are incorporated herein by reference. Further, the tobacco extract could be treated with ion exchange materials having amine functionality, which can remove certain aldehydes and other compounds. See, for example, U.S. Pat. No. 4,033,361 to Horsewell et al. and U.S. Pat. No. 6,779,529 to Figlar et al., which are incorporated by reference herein.

The amount of aerosol precursor material that is used within the smoking article is such that the article exhibits acceptable sensory and organoleptic properties, and desirable performance characteristics. For example, it is highly preferred that sufficient aerosol precursor material, such as glycerin and/or propylene glycol, be employed in order to provide for the generation of a visible mainstream aerosol that in many regards resembles the appearance of tobacco smoke. Typically, the amount of aerosol-generating material incorporated into the smoking article is in the range of about 1.5 g or less, about 1 g or less, or about 0.5 g or less. The amount of aerosol precursor material can be dependent upon factors such as the number of puffs desired per cartridge used with the smoking article. It is desirable for the aerosol-generating composition not to introduce significant degrees of unacceptable off-taste, filmy mouth-feel, or an overall sensory experience that is significantly different from that of a traditional type of cigarette that generates mainstream smoke by burning tobacco cut filler. The selection of the particular aerosol-generating material and reservoir material, the amounts of those components used, and the types of tobacco material used, can be altered in order to control the overall chemical composition of the mainstream aerosol produced by the smoking article.

The amount of aerosol released by the inventive article can vary. Preferably, the article is configured with a sufficient amount of the aerosol precursor material, with a sufficient amount of any further inhalable substance, and to function at a sufficient temperature for a sufficient time to release a desired content of aerosolized materials over a course of use. The content may be provided in a single inhalation from the article or may be divided so as to be provided through a number of puffs from the article over a relatively short length of time (e.g., less than 30 minutes, less than 20 minutes, less than 15 minutes, less than 10 minutes, or less than 5 minutes). For example, the article may provide nicotine in an amount of about 0.01 mg to about 0.5 mg, about 0.05 mg to about 0.3 mg, or about 0.1 mg to about 0.2 mg, per puff on the article. For purposes of calculations, an average puff time of about 2 seconds can deliver a puff volume of about 5 ml to about 100 ml, about 15 ml to about 70 ml, about 20 ml to about 60 ml, or about 25 ml to about 50 ml. A smoking article according to the disclosure can be configured to provide any number of puffs calculable by the total amount of aerosol or other inhalable substance to be delivered divided by the amount to be delivered per puff. The one or more reservoirs can be loaded with the appropriate amount of aerosol precursor or other inhalable substance to achieve the desired number of puffs and/or the desired total amount of material to be delivered.

In further embodiments, heating can be characterized in relation to the amount of aerosol to be generated. Specifically, the article can be configured to provide an amount of heat necessary to generate a defined volume of aerosol (e.g., about 5 ml to about 100 ml, or any other volume deemed useful in a smoking article, such as otherwise described herein). In certain, the amount of heat generated can be measured in relation to a two second puff providing about 35 ml of aerosol at a heater temperature of about 290° C. In some embodiments, the article preferably can provide about 1 to about 50 Joules of heat per second (J/s), about 2 J/s to about 40 J/s, about 3 J/s to about 35 J/s, or about 5 J/s to about 30 J/s.

The resistive heating element preferably is in electrical connection with the power source of the smoking article such that electrical energy can be provided to the resistive heating element to produce heat and subsequently aerosolize the aerosol precursor material and any other inhalable substance provided by the smoking article. Such electrical connection can be permanent (e.g., hard wired) or can be removable (e.g., wherein the resistive heating element is provided in a cartridge that can be attached to and detached from a control body that includes the power source).

Although a variety of materials for use in a smoking article according to the present disclosure have been described above—such as heaters, batteries, capacitors, switching components, aerosol precursors, and the like, the disclosure should not be construed as being limited to only the exemplified embodiments. Rather, one of skill in the art can recognize based on the present disclosure similar components in the field that may be interchanged with any specific component of the present disclosure. For example, U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; US 2009/0320863 by Fernando et al. discloses computer interfacing means for smoking devices to facilitate charging and allow computer control of the device; US 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; US Pat. Pub. Nos. 2009/0095311, 2006/0196518, 2009/0126745, and 2009/0188490 to Hon; US Pat. Pub. No. 2009/0272379 to Thorens et al.; US Pat. Pub. Nos. 2009/0260641 and 2009/0260642 to Monsees et al.; US Pat. Pub. Nos. 2008/0149118 and 2010/0024834 to Oglesby et al.; US Pat. Pub. No. 2010/0307518 to Wang; and WO 2010/091593 to Hon. A variety of the materials disclosed by the foregoing documents may be incorporated into the present devices in various embodiments, and all of the foregoing disclosures are incorporated herein by reference in their entireties.

Although an article according to the disclosure may take on a variety of embodiments, as discussed in detail below, the use of the article by a consumer will be similar in scope. In particular, the article can be provided as a single unit or as a plurality of components that are combined by the consumer for use and then are dismantled by the consumer thereafter. Generally, a smoking article according to the disclosure can comprise a first unit that is engagable and disengagable with a second unit, the first unit comprising the resistive heating element, and the second unit comprising the electrical power source. In some embodiments, the second unit further can comprise one or more control components that actuate or regulate current flow from the electrical power source. The first unit can comprise a distal end that engages the second unit and an opposing, proximate end that includes a mouthpiece (or simply the mouth end) with an opening at a proximate end thereof. The first unit can comprise an air flow path opening into the mouthpiece of the first unit, and the air flow path can provide for passage of aerosol formed from the resistive heating element into the mouthpiece. In preferred embodiments, the first unit can be disposable. Likewise, the second unit can be reusable.

More specifically, a smoking article according to the disclosure can have a reusable control body that is substantially cylindrical in shape having a connecting end and an opposing, closed end. The closed end of the control housing may include one or more indicators of active use of the article. The article further can comprise a cartridge with a connecting end that engages the connecting end of the control body and with an opposing mouth end. To use the article, the consumer can connect a connecting end of the cartridge to the connecting end of the control body or otherwise combine the cartridge with the control body so that the article is operable as discussed herein. In some embodiments, the connecting ends of the control body and the cartridge can be threaded for a screw-type engagement. In other embodiments, the connecting ends can have a press-fit engagement.

During use, the consumer initiates heating of the resistive heating element, the heat produced by the resistive heating element aerosolizes the aerosol precursor material and, optionally, further inhalable substances. Such heating releases at least a portion of the aerosol precursor material in the form of an aerosol (which can include any further inhalable substances included therewith), and such aerosol is provided within a space inside the cartridge that is in fluid communication with the mouth end of the cartridge. When the consumer inhales on the mouth end of the cartridge, air is drawn through the cartridge, and the combination of the drawn air and the aerosol is inhaled by the consumer as the drawn materials exit the mouth end of the cartridge (and any optional mouthpiece present) into the mouth of the consumer. To initiate heating, the consumer may actuate a pushbutton, capacitive sensor, or similar component that causes the resistive heating element to receive electrical energy from the battery or other energy source (such as a capacitor). The electrical energy may be supplied for a pre-determined length of time or may be manually controlled. Preferably, flow of electrical energy does not substantially proceed in between puffs on the article (although energy flow may proceed to maintain a baseline temperature greater than ambient temperature—e.g., a temperature that facilitates rapid heating to the active heating temperature). In further embodiments, heating may be initiated by the puffing action of the consumer through use of various sensors, as otherwise described herein. Once the puff is discontinued, heating will stop or be reduced. When the consumer has taken a sufficient number of puffs so as to have released a sufficient amount of the inhalable substance (e.g., an amount sufficient to equate to a typical smoking experience), the cartridge can be removed from the control housing and discarded. Indication that the cartridge is spent (i.e., the aerosol precursor material has been substantially removed by the consumer) can be provided. In some embodiments, a single cartridge can provide more than a single smoking experience and thus may provide a sufficient content of aerosol precursor material to simulate as much as full pack of conventional cigarettes or even more. Likewise, a plurality of individual reservoirs can be provided in a single smoking article to provide a defined number of puffs, conventional cigarette equivalents, or the like.

The foregoing description of use of the article can be applied to the various embodiments described through minor modifications, which can be apparent to the person of skill in the art in light of the further disclosure provided herein. The above description of use, however, is not intended to limit the use of the inventive article but is provided to comply with all necessary requirements of disclosure of the present disclosure.

Referring now to FIG. 1, a smoking article 10 according to the disclosure generally can comprise a shell 15 and a plurality of components provided within the shell. The article can be characterized as having a mouth end 11 (i.e., the end upon which a consumer can draw to inhale aerosol from the article), and a distal end 12. The illustrated article is provided as a single unitary device (however, line A indicates an optional demarcation whereby the device can be two separate components that are joined together, either removably or permanently, such as by gluing). As will be evident from the further disclosure herein, it can be preferable for further embodiments of the article to be formed of two or more detachable units, each housing separate components of the article. The various components shown in the embodiment of FIG. 1 can be present in other embodiments, including embodiments formed of multiple units.

The article 10 according to the disclosure can have an overall shape that may be defined as being substantially rod-like or substantially tubular shaped or substantially cylindrically shaped. As illustrated in FIG. 1, the article has a substantially round cross-section; however, other cross-sectional shapes (e.g., oval, square, triangle, etc.) also are encompassed by the present disclosure. Such language that is descriptive of the physical shape of the article may also be applied to the individual units of the article in embodiments comprising multiple units, such as a control body and a cartridge.

The shell 15 of the smoking article 10 can be formed of any material suitable for forming and maintaining an appropriate conformation, such as a tubular shape, and for retaining therein the suitable components of the article. The shell can be formed of a single wall, as shown in FIG. 1. In some embodiments, the shell can be formed of a material (natural or synthetic) that is heat resistant so as to retain its structural integrity—e.g., does not degrade—at least at a temperature that is the heating temperature provided by the resistive heating element, as further discussed herein. In some embodiments, a heat resistant polymer may be used. In other embodiments, the shell can be formed from paper, such as a paper that is substantially straw-shaped. As further discussed herein, the shell, such as a paper tube, may have one or more layers associated therewith that function to substantially prevent movement of vapor therethrough. In one example, an aluminum foil layer may be laminated to one surface of the shell. Ceramic materials also may be used.

The shell 15, when formed of a single layer, can have a thickness of about 0.2 mm to about 5.0 mm, about 0.5 mm to about 4.0 mm, about 0.5 mm to about 3.0 mm, or about 1.0 mm to about 3.0 mm. Further exemplary types of components and materials that may be used to provide the functions described above or be used as alternatives to the materials and components noted above can be those of the types set forth in US Pub. No. 2010/00186757 to Crooks et al.; US Pub. No. 2010/00186757 to Crooks et al.; and US Pub. No. 2011/0041861 to Sebastian et al.; the disclosures of which are incorporated herein by reference in their entireties.

As seen in the embodiment of FIG. 1, the smoking article 10 generally includes an electronic control component 20, a flow sensor 30, and a battery 40, and these components can be placed in a variety of orders within the article. Although not expressly shown, it is understood that the article 10 can include wiring as necessary to provide power from the battery 40 to the further components and to interconnect the components for appropriate operation of the necessary functions provided by the article. The article 10 further includes a resistive heating element 50 as described herein. In the illustrated embodiment, the resistive heating element 50 is a metal coil that can be electrically connected to the battery 40 through appropriate wiring of the terminals 51 to facilitate formation of a closed electrical circuit with current flow through the heating element. Further wiring (not illustrated) can be included to provide the necessary electrical connections within the article. In specific embodiments, the article 10 can be wired with an electrical circuit such that the control component 20 delivers, controls, or otherwise modulates power from the battery 40 for energizing the resistive heating element 50 according to one or more defined algorithms, such as already described above. Such electrical circuit can specifically incorporate the flow sensor 30 such that the article 10 is only active at times of use by the consumer. For example, when a consumer puffs on the article 10, the flow sensor detects the puff, and the control component 20 is then activated to direct power through the article such that the resistive heating element 50 produces heat and thus provides aerosol for inhalation by the consumer. The control algorithm may call for power to the resistive heating element 50 to cycle and thus maintain a defined temperature. The control algorithm therefore can be programmed to automatically deactivate the article 10 and discontinue power flow through the article after a defined time lapse without a puff by a consumer. Moreover, the article can include a temperature sensor to provide feedback to the control component. Such sensor can be, for example, in direct contact with the resistive heating element 50. Alternative temperature sensing means likewise may be used, such as relying upon logic control components to evaluate resistance through the resistive heating element and correlate such resistance to the temperature of the element. In other embodiments, the flow sensor 30 may be replaced by appropriate components to provide alternative sensing means, such as capacitive sensing, as otherwise described herein. Any variety of sensors and combinations thereof can be incorporated, as already described herein. Still further, one or more control buttons 16 can be included to allow for manual actuation by a consumer to elicit a variety of functions, such as powering the article 10 on and off, turning on the heating element 50 to generate a vapor or aerosol for inhalation, or the like.

Additionally, the article can include on or more status indicators 19 positioned on the shell 15. Such indicators, as discussed above, can show the number of puffs taken or remaining from the article, can be indicative of an active or inactive status, can light up in response to a puff, or the like. Although six indicators are illustrated, more or fewer indicators can be present, and the indicators can take on different shapes and can even being simply an opening in the shell (such as for release of sound when such indicators are present).

As illustrated in the embodiment of FIG. 1, a reservoir 205 is shown in proximity to the heating element 50, and a wick 300 extends from the reservoir 205 and into the coil of the resistive heating element 50. The reservoir is one embodiment illustrating means of storing an aerosol precursor material. The wick utilizes capillary action to draw the aerosol precursor material from the reservoir and into a heating zone defined by the area in and around the resistive heating element 50 in the form of a metal wire coil. As such, heat produced by the resistive heating element causes the aerosol precursor material to aerosolize. The formed aerosol is then drawn by a user through the mouth end 11 of the smoking article 10. As the aerosol precursor material in the heating zone is aerosolized by the heating of the resistive heating element, further aerosol precursor material is wicked out of the reservoir 205 to the heating zone for aerosolization. The cycle continues until substantially all of the aerosol precursor material has been aerosolized.

As seen in the embodiment of FIG. 1, the mouth end 11 of the article 10 is substantially an open cavity with the resistive heating element 50 and the reservoir 205 disposed therein. Such open cavity provides a volume for release of the aerosol from the wick 300 as it is withdrawn from the reservoir and heated by the resistive heating element. The article also includes a mouth opening 18 in the mouth end 11 to allow for withdrawal of the aerosol from the cavity around the resistive heating element 50. Although not expressly shown in the illustration of FIG. 1, the article can include a filter material (such as cellulose acetate or polypropylene) in the mouth end thereof to increase the structural integrity thereof and/or to provide filtering capacity, if desired, and/or to provide resistance to draw. To facilitate air flow through the article, an air intake 17 can be provided and can substantially comprise an aperture in the shell 15 that allows for air flow into the interior of the article. A plurality of air intakes can be provided, and the air intakes can be positioned at any location upstream from the mouth end of the article such that air from the air intake can mingle with and facilitate removal of the formed aerosol from the cavity around the resistive heating element/substrate and through the opening in the mouth end of the article. Although not illustrated, if desired, structural elements can be provided within the article so as to effectively isolate one or more components within the article from the air flowing from the air intake to the opening in the mouth end. In other words, a defined air flow path can be provided, and such defined air flow path can substantially avoid air flowing through the air flow path from coming into physical contact with one or both of the battery 40 and the control component 20. As illustrated in FIG. 1, air taken in through the air intake 17 passes the flow sensor 30 before entering the cavity surrounding the heating element/substrate such that activation of the flow sensor will facilitate heating of the heating element, as otherwise described herein.

In preferred embodiments, the article 10 may take on a size that is comparative to a cigarette or cigar shape. Thus, the article may have a diameter of about 5 mm to about 25 mm, about 5 mm to about 20 mm, about 6 mm to about 15 mm, or about 6 mm to about 10 mm. Such dimension may particularly correspond to the outer diameter of the shell 15.

The smoking article 10 in the embodiment illustrated in FIG. 1 can be characterized as a disposable article. Accordingly, it can be desirable for the reservoir containing the aerosol precursor material in such embodiments to include a sufficient amount of aerosol precursor material so that a consumer can obtain more than a single use of the article. For example, the article can include sufficient aerosolizable and/or inhalable materials such that the article can provide a number of puffs substantially equivalent to the number of puffs (of about two seconds duration) available from a plurality of conventional cigarettes—e.g., 2 or more, 5 or more, 10 or more, or 20 or more conventional cigarettes. More particularly, a disposable, single unit article according to the embodiment of FIG. 1 can provide about 20 or more, about 50 or more, or about 100 or more puffs, a single puff being measured as already described herein.

Figure 2:
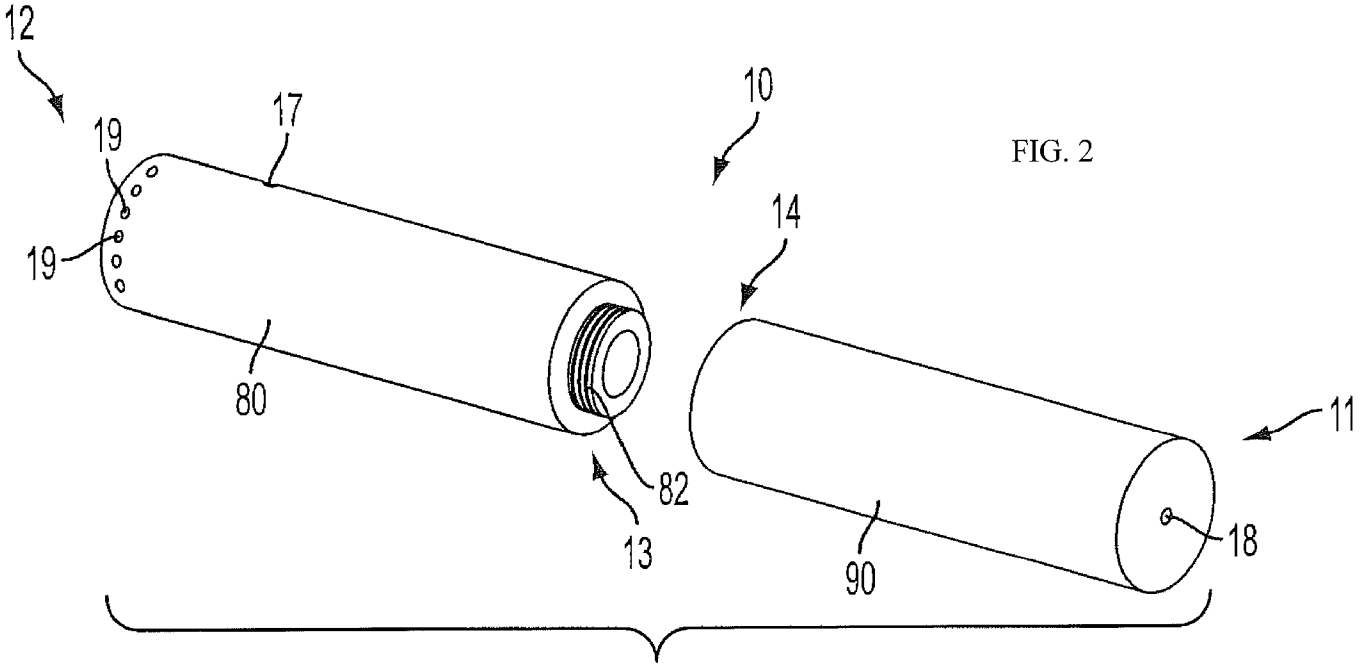
FIG. 2 is a perspective view of an example embodiment of a smoking article according to the disclosure, wherein the article comprises a control body and a cartridge that are attachable and detachable with respect to each other.

In particularly preferred embodiments an article according to the disclosure can comprise two units that are attachable and detachable from each other. For example, FIG. 2 shows a smoking article 10 according to one embodiment that is formed of a control body 80 and a cartridge 90. In specific embodiments, the control body may be referred to as being reusable, and the cartridge may be referred to as being disposable. In some embodiments, the entire article may be characterized as being disposable in that the control body may be configured for only a limited number of uses (e.g., until a battery power component no longer provides sufficient power to the article) with a limited number of cartridges and, thereafter, the entire article 10, including the control body, may be discarded. In other embodiments, the control body may have a replaceable battery such that the control body can be reused through a number of battery exchanges and with many cartridges. Similarly, the article 10 may be rechargeable and thus may be combined with any type of recharging technology, including connection to a typical electrical outlet, connection to a car charger (i.e., cigarette lighter receptacle), and connection to a computer, such as through a USB cable.

The control body 80 and the cartridge 90 are specifically configured so as to engage one another and form an interconnected, functioning device. As illustrated in FIG. 2, the control body 80 includes a proximal attachment end 13 that includes a projection 82 having a reduced diameter in relation to the control body. The cartridge includes a distal attachment end 14 that engages the proximal engagement end of the control body 80 to provide the smoking article 10 in a functioning, usable form. In FIG. 2, the control body projection 82 includes threads that allow the cartridge 90 to screw onto the control body 80 via corresponding threads (not visible in FIG. 2) in the distal attachment end of the cartridge. Thus, the distal attachment end of the cartridge 90 can include an open cavity for receiving the control body projection 82. Although a threaded engagement is illustrated in FIG. 2, it is understood that further means of engagement are encompassed, such as a press-fit engagement, a magnetic engagement, or the like.

Figure 3:
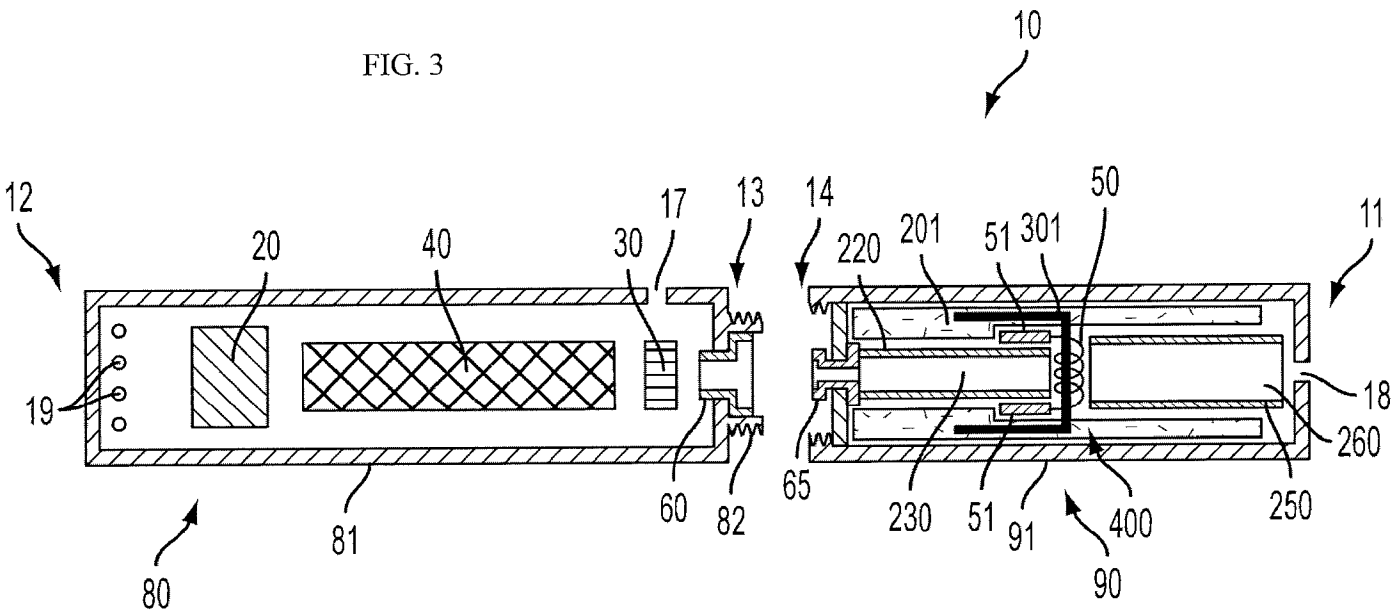
FIG. 3 is a longitudinal cross-section of a smoking article according to an example embodiment of the disclosure.

The functioning relationship between the control body 80 and the cartridge 90 is further seen in FIG. 3, which shows the two detached units in cross section. The control body 80 includes the control component 20, flow sensor 30, and battery 40. Although these components are illustrated in a specific alignment, it is understood that various alignments of the components are encompassed by the disclosure. The control body 80 further includes a plurality of indicators 19 and an air intake 17 in the control body shell 81. A variety of positions for one or more air intakes are encompassed by the disclosure. As shown, the air intake 17 is positioned such that air drawn through the intake sufficiently contacts the flow sensor 30 to activate the sensor (although other positions are encompassed, particular if different sensing means are provided or if manual actuation, such as with a push button, is provided). In other instances, the air intake 17 may be positioned, for example, toward the distal end 12, with the flow sensor 30 being disposed proximally to the distal end 12, toward the proximal attachment end 13. In such instances, for instance, the disposition of the air intake toward the distal end 12 may provide additional lead time from detecting the puff for the heating element 50 to be actuated, thereby providing a faster response (i.e., delivery of the aerosol) in response to the puff. The shell 81 can be formed of materials already described herein in relation to the embodiment of FIG. 1. A receptacle 60 also is included at the proximal attachment end 13 of the control body 80 and extends into the control body projection 82 to allow for ease of electrical connection with the resistive heating element 50 when the cartridge 90 is attached to the control body. In the illustrated embodiment, the receptacle 60 includes a central open passage to facilitate air flow from the air intake in the control body into the cartridge during use of the article 10.

The cartridge 90 includes a cartridge shell 91 with a mouth opening 18 at the mouth end 11 thereof to allow passage of air and entrained vapor (and further inhalable materials, if present) from the cartridge to a consumer during draw on the article 10. The cartridge shell 91 can be formed of materials as already described herein as being useful for such purpose. The cartridge 90 further includes a resistive heating element 50 in the form of a metal wire coil. The resistive heating element includes terminals 51 (e.g., positive and negative terminals) at the opposing ends thereof for facilitating current flow through the resistive heating element and for attachment of the appropriate wiring (not illustrated) to form an electrical connection of the resistive heating element with the battery 40 when the cartridge 90 is connected to the control body 80. Specifically, a plug 65 is positioned at the distal attachment end 14 of the cartridge. When the cartridge 90 is connected to the control body 80, the plug 65 engages the receptacle 60 to form an electrical connection such that current controllably flows from the battery 40, through the receptacle and plug, and to the resistive heating element 50. The cartridge shell 91 can continue across the distal attachment end such that this end of the cartridge is substantially closed with the plug protruding therefrom. As illustrated in FIG. 3, the plug 65 includes an open central passage that aligns with the open central passage in the receptacle 60 to allow air to flow from the control body 80 and into the cartridge 90.

A reservoir for use according to the present disclosure can be any component that functions to store and release one or more components of the aerosol precursor material. In some embodiments, such as illustrated in FIG. 1, the reservoir can be a container in which the aerosol precursor material is stored. The container can be substantially impermeable in relation to the aerosol precursor such that the material cannot escape through the walls of the container. In such embodiments, an opening can be provided for passage of the aerosol precursor material therefrom. For example, in FIG. 1, a wick 300 is shown filling an opening in the reservoir 205. In some instances, the reservoir 205 may comprise a "bottle," which may generally encompass any container having walls and at least one opening. The aerosol precursor material in the reservoir thus moves out of the reservoir by capillary action via the wick. Other systems for passage of the aerosol precursor material from a reservoir are also encompassed by the disclosure. For example, a tube or other conduit can be used for passage of the aerosol precursor material out of the reservoir and through the tube or other conduit. Such passage also can occur via capillary action. Alternately, passive flow of the liquid from the reservoir can be controlled with an appropriate valve mechanism that can be opened to allow flow of the aerosol precursor material when the smoking article is in use and to prevent flow of the aerosol precursor material when the smoking article is not in use. Active flow mechanisms incorporating micro-pump devices also are envisioned for use according to the present disclosure. Such a reservoir can be formed of any suitable material that is not substantially reactive with any components of the aerosol precursor material, and is thermally and mechanically stable, such as glass, metal, low- or no-porosity ceramics, plastics, and the like.

In some embodiments, a reservoir can be a container that is provided without an opening, but a portion or all of the walls of the container can be porous and thus allow permeation of the aerosol precursor material out of the container through the walls thereof. For example, porous ceramics can be useful in such regard. Any other material of suitable porosity likewise could be used.

In particular embodiments, a reservoir can be a woven or non-woven fabric or another mass of fibers suitable for retaining the aerosol precursor material (e.g., through absorption, adsorption, or the like) and allowing wicking away of the aerosol precursor material for transport to the heating zone. For example, FIG. 3 illustrates a reservoir layer 201 retaining one or more components of the aerosol precursor material. The reservoir layer is essentially a non-woven layer of fibers rolled into the form of a tube that lines a portion of the inner surface of the cartridge shell 91. Such reservoir layer can be formed of natural fibers, synthetic fibers, or combinations thereof. Non-limiting examples of useful materials include cotton, cellulose, cellulose acetate, polyesters, polyamides, polylactic acids, combinations thereof, and the like. Similarly, reservoir layers can be formed of ceramics.

A wick 301 (as seen in FIG. 3) for use according to the present disclosure can be any component that functions to transport one or more aerosol precursor materials from a reservoir to a heating zone in the smoking article where a resistive heating element aerosolizes the aerosol precursor material and thus form an aerosol. A wick particularly can be a component that utilizes capillary action in the transport of liquids. A wick for use according to the disclosure thus can be any material that provides sufficient wicking action to transport one or more components of the aerosol precursor material to the heating zone. Non-limiting examples include natural and synthetic fibers, such as cotton, cellulose, polyesters, polyamides, polylactic acids, glass fibers, combinations thereof, and the like. Wicks further can be coated with materials that alter the capillary action of the fibers, and the fibers used in forming wicks can have specific cross-sectional shape and can be grooved so as to alter the capillary action of the fibers. Fibers used in forming wicks can be bundled, provided as a woven fabric, or provided as a non-woven fabric.

Figure 4:
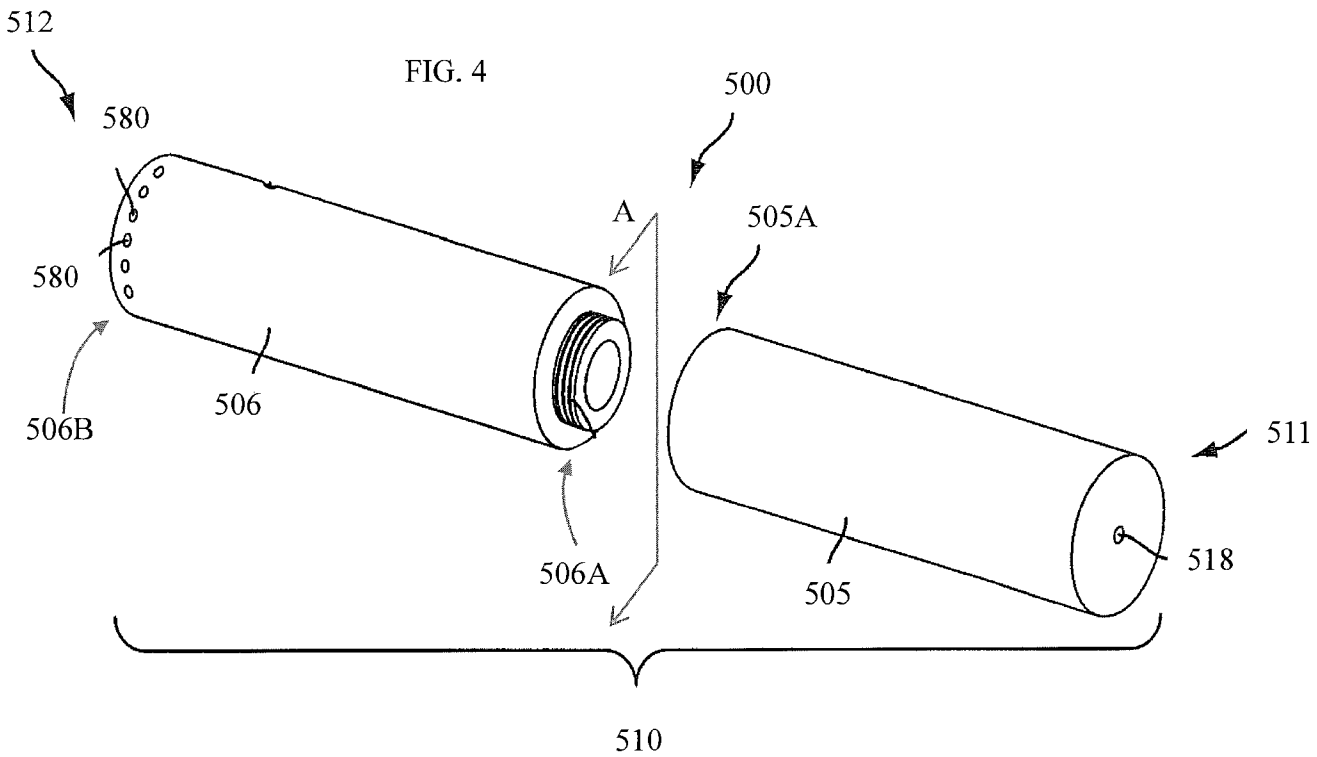
FIG. 4 is a perspective view of an example embodiment of a smoking article according to another aspect of the disclosure, wherein the article comprises a control body and a cartridge that are attachable and detachable with respect to each other.

FIG. 4 schematically illustrates a smoking article 500 according to one aspect of the present disclosure. In such an aspect, the smoking article 500 may generally comprise a shell 510 having a mouth end 511 (i.e., the end upon which a consumer can draw to inhale aerosol from the article through the mouth opening 518), and an opposed distal end 512. The smoking article 500 according to the present aspect is illustrated as a two-part device, wherein line A indicates a demarcation whereby the smoking article 500 can be separated or otherwise disengaged into two separate components 505, 506. In such instances, the two separate components may be designated as a control body portion 506 and a cartridge body portion 505 that are joined together along a longitudinal axis. More particularly, the control body portion 506 may define a control body engagement end 506A and the cartridge body portion 505 may define a cartridge body engagement end 505A, wherein the respective ends 505A, 506A may be complementarily configured so as to be capable of being removably engaged. That is, when the respective ends 505A, 506A are engaged the body portions 505, 506 are secured together to form the smoking article 500. However, in particular instances, the body portions 505, 506 may be separated or detached (i.e., detachable units), as necessary or desired, for example, such that the cartridge body portion 505 may be exchanged for a different cartridge body portion. In such instances, the detachable units may each be configured to house separate components of the smoking article 500.

Figure 5:
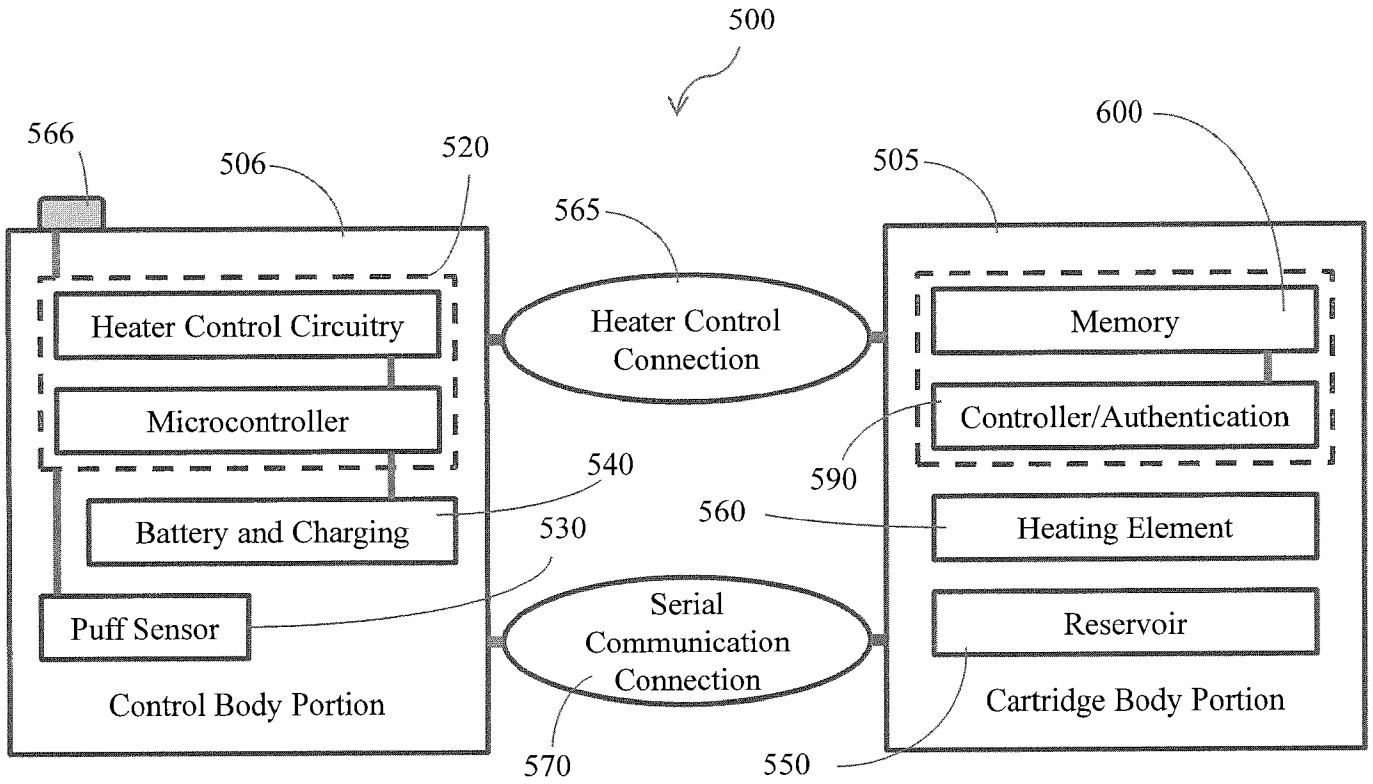
FIG. 5 is a schematic of operational components included in the respective body components of a smoking article as shown, for example, in FIG. 4.

According to one aspect, the smoking article 500 may comprise detachable control and cartridge body portions 506, 505. As seen in the embodiment of FIG. 4, the components housed by the shell 510 may be divided between the control and cartridge body portions 506, 505. For example, in instances where the cartridge body portion 505 is configured to be interchangeable with other cartridge body portions using the same control body portion 506, the control body portion 506 may have arranged therein the components that may be re-usable in such a smoking article 500. Moreover, the cartridge body portion 505 may include a consumable arrangement comprising at least an aerosol precursor composition (otherwise interchangeably referred to herein as an "aerosol precursor material") and at least one heating element operably engaged therewith. As such, in some aspects as schematically shown in FIG. 5, the control body portion 506 of the smoking article 500 may include a first electronic control component 520, a flow sensor (or "puff sensor") 530, and an electrical power source 540 (i.e., a battery, a capacitor, or any other suitable electrical power-containing element or combination of elements) and these components can be placed in a variety of orders within the control body portion 506. Such components may also be configured to be controlled through or by the first electronic control component 520 (i.e., the first control component 520 may be configured to control access to the power stored by the electrical power source 540 such as, for example, to power the flow (puff) sensor 530). Further, although not expressly shown, it is understood that the article 500 can include wiring, or otherwise include suitable provisions for electrically connecting particular components, as necessary or desired to provide electrical power or current from the battery 540 to other components and/or to interconnect particular components for appropriate operation of the necessary functions provided by the smoking article.

As illustrated in the embodiment of FIG. 5, the cartridge body portion 505 of the smoking article 500 may include and contain a consumable arrangement comprising a reservoir 550 disposed in proximity to a heating element 560 in the form of, for example a coil. In some aspects, a wick (not shown, but see, e.g., element 300 in FIG. 1) may extend from the reservoir 550 into the coil of the heating element 560. The reservoir 550 may be configured, in one aspect, to store an aerosol precursor material, as further discussed herein, which may be in the form of a liquid, vapor, or aerosol. The wick may be configured and arranged to be in communication with the reservoir 550 so as to utilize capillary action to draw the aerosol precursor material from the reservoir and into a heating zone defined by an area in and around, or otherwise in proximity to, the heating element 560 (i.e., inside the coil). As such, heat produced by the heating element 560 causes the aerosol precursor material to aerosolize. The formed aerosol is then drawn by a user through the mouth end 511 of the smoking article 500. As the aerosol precursor material in the heating zone is aerosolized by the heating of the heating element 560, further aerosol precursor material is wicked out of the reservoir 550 and directed toward the heating zone for aerosolization. The cycle continues until substantially all of the aerosol precursor material has been aerosolized and the reservoir is substantially empty.

In one aspect, the heating element 560 may be a resistive element comprising a metal coil that can be electrically connected to the battery 540 through appropriate wiring of the terminals thereof to facilitate formation of a closed electrical circuit capable of current flow through the heating element 560. Accordingly, the control and cartridge body portions 505, 506 may be configured such that, when engaged, appropriate wiring 565 forms the necessary electrical and control connections within the smoking article 500 between the battery 540 and the heating element 560. Such an electrical/control connection may be accomplished, for example, through the use of an electrical connector having complementarily configured portions, wherein one portion is engaged with the control body portion 506 and the other portion is engaged with the cartridge body portion 505, the respective portions being urged into engagement upon engagement of the control and cartridge body portions 506, 505. In particular embodiments, the article 500 can be wired with an electrical circuit whereby the first control component 520 is configured to deliver, control, or otherwise modulate power from the battery 540 for energizing the resistive heating element 560 according to one or more defined algorithms, such as previously described above. Such an electrical circuit ("heater control circuitry") can specifically incorporate the flow sensor 530 such that the article 500 is only active at times of use by the consumer. For example, when a consumer puffs on the article 500, the flow sensor 530 (which may also comprise, for example, a pressure sensor, a capacitive sensor, or other appropriate sensor for detecting actuation of the article 500 due to a puff by the user) detects the puff, and the first control component 520 is then activated to direct power through the article 500 from the battery 540 to the heating element 560, such that the heating element 560 produces heat and thus provides aerosol for inhalation by the consumer. The control algorithm may call for power to the heating element 560 to cycle and thus maintain a defined and selected temperature in the heating zone proximate to the aerosol precursor material. The control algorithm can be further programmed to automatically deactivate the article 500 by discontinuing power flow through the article 500 from the battery 540 to the heating element 560 after a defined time lapse without detecting a puff by a consumer. Moreover, the article 500 can include a temperature sensor (not shown) in the cartridge body portion 505 to provide feedback to the first control component 520. Such sensor can be, for example, in direct contact with the heating element 560. In some instances, a regulator component (not shown) may be provided in communication between the electrical power source 540 and the at least one heating element 560, with the regulator component being configured to selectively regulate current flow from the electrical power source 540 to the at least one heating element 560 in order to control a temperature thereof. Alternative temperature sensing arrangements may be used, such as logic control components to evaluate a resistance of the heating element and to correlate such resistance to the temperature of the element. In other instances, the heating element 560 may be engaged with the first control component 520 via a feedback loop, wherein, for example, a comparator may compare a measured electrical parameter (i.e., voltage, current) at the heating element 560 to a desired set point, and adjust the output of that electrical parameter from the electrical power source 540. In other aspects, the flow sensor 530 may be replaced by appropriate components to provide alternative sensing of user demand on the smoking article 500, such as capacitive sensing, as otherwise described herein. Any variety of sensors and combinations thereof can be incorporated, as already described herein. Still further, one or more control buttons 566 can be included in association with the control body portion 506 to allow for manual actuation of the smoking article 500 by a consumer to elicit a variety of functions, such as powering the article 500 on and off, turning on the heating element 560 to generate a vapor or aerosol for inhalation, or the like.

Additionally, the article can include on or more status indicators 580 (see, e.g., FIG. 4) positioned on the shell 510, either in association with the control body portion 506 or the cartridge body portion 505, as appropriate or desired. Such indicators, as discussed above, can show the number of puffs taken or remaining from the article/cartridge body portion, can be indicative of an active or inactive status, can light up in response to a puff, or the like. Although six indicators are illustrated, more or fewer indicators can be present. Such indicators can take on different shapes and may even simply define an opening in the shell (such as for release of sound when such indicators are present). As previously discussed, any such status indicators 580 are suitably wired for communication with the battery 540, for example, via the first control component 520 and/or through appropriate connectors between the control and cartridge body portions 506, 505.

Figure 6:
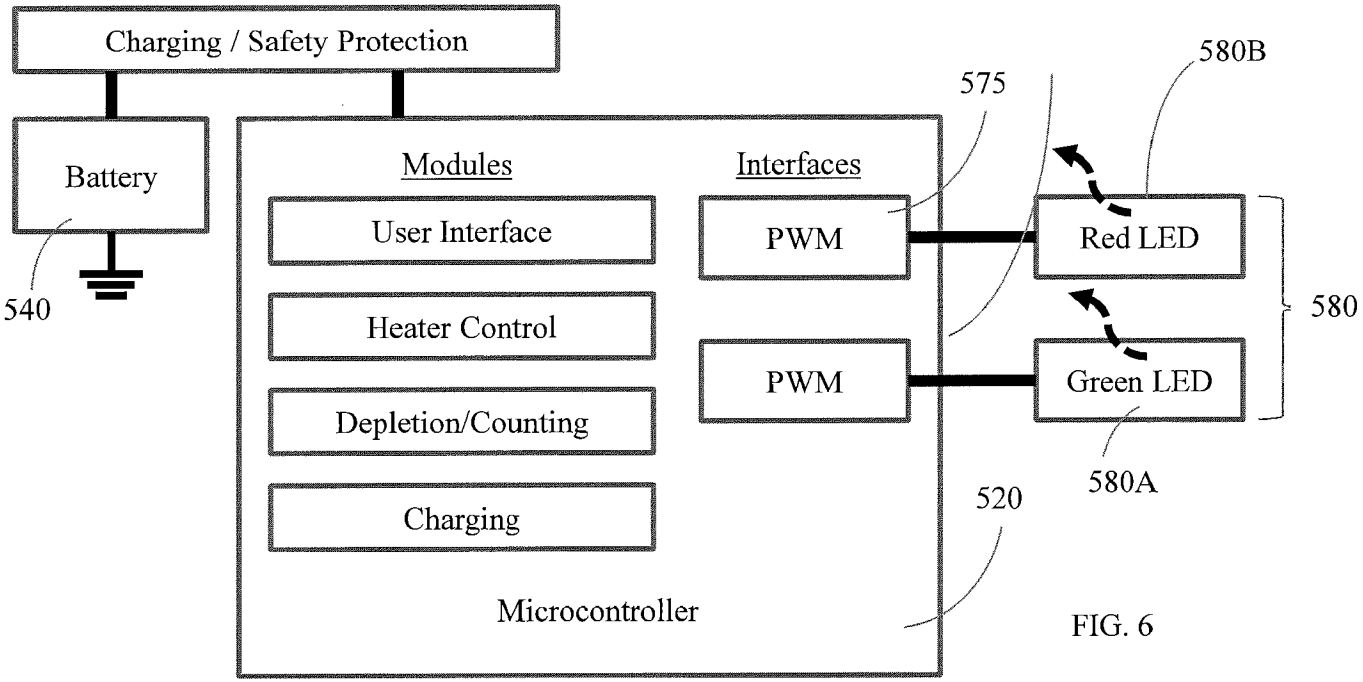
FIG. 6 is a schematic of operational components of a smoking article arranged to provide an adaptive color indicia, according to one aspect of the disclosure.

In one instance, one or more status indicators 580 may be arranged in connection with the cartridge body portion 505, about a tip 505B thereof, the tip 505B being opposed to the cartridge body engagement end 505A. The one or more status indicators 580 about the tip 505B may, in some aspects, comprise one or more LEDs or other appropriate light-emitting element. The one or more status indicators 580 may be arranged in communication with the first and/or second control component 520, 590, wherein the first and/or second control component 520, 590 may be configured to control the actuation of one or more of the status indicators 580 (see, e.g., FIG. 6). For example, the one or more status indicators 580 may be configured to be responsive to actuation of the puff sensor 530 to emit light upon detection of a puff by the user. The characteristics of the puff used to actuate the puff sensor 530 may, in turn, be reflected in the light emitted by the one or more status indicators 580. For example, the intensity and/or duration of the puff may result in actuation of the one or more status indicators 580 for a corresponding intensity and/or duration. In other instances, in addition to or in the alternative to a corresponding intensity and/or duration, the blended or apparent color of the light emitted by the one or more status indicators 580 may also vary accordingly. For instance, by actuating the one or more status indicators 580, for example, with a Pulse Width Modulated (PWM) actuation signal (see, e.g., element 575 in FIG. 6), the one or more status indicators 580 can be actuated with modulated intensity to emulate or mimic the color of a glowing/burning tip of a conventional smoking article, such as a cigarette. In one particular instance, the one or more status indicators 580 may comprise a green LED 580A and a red LED 580B. The duty cycles of the green and red LEDs may be controlled by one or more PWM or other control signals such that the status indicators 580 combine in various proportions to emit a blended color ranging from red to orange to yellow. One skilled in the art will appreciate, however, that the one or more status indicators 580 may be actuated in different manners as necessary or desired. For example, an analog circuit may be used to vary the voltage and/or current directed to each of the green and red LEDs to produce the desired color of light emitted from the tip 505B, or the associated circuitry may or may not implement a microprocessor.

As disclosed, in one aspect of the present disclosure, the cartridge body portion 505 may also include a second electronic control component 590 (which may or may not include a microprocessor), as shown in FIG. 5. The second control component 590 may be configured, for instance, to communicate with the first control component 520 (via established serial communication connection 570) and/or the electrical power source 540 upon engagement between the cartridge body and control body portions 506, 505. The second electronic control component 590 may comprise a processor, may be configured as purpose-specific analog and/or digital circuitry with or without a processor, or may comprise hardware, software, or a combination of hardware and software. Accordingly, any or all of the functions disclosed herein in conjunction with the second electronic control component 590, including interaction thereof with the first electronic control component 520 and other components of the smoking article 500, may be embodied in a computer-readable storage medium having computer-readable program code portions stored therein that, in response to execution by a processor, cause an apparatus to at least perform or direct the recited functions. In one particular instance, upon establishment of communication between the first and second control components 520, 590, such as upon engagement of the control body and cartridge body portions 506, 505, the second control component 590 may be configured to provide an authentication code or other appropriate indicia to the first control component 520. In such instances, the first control component 520 may be configured to evaluate the authentication indicia to determine whether the cartridge body portion 505 is authorized for use with the control body portion 506. Such authentication may involve, for example, a determination as to whether the cartridge body portion 505 is produced by the manufacturer of the control body portion 506 (i.e., the control body portion 506 may only be used with a cartridge body portion 505 manufactured or authorized by the same manufacturer of the control body portion 506). In other instances, this concept may be extended to authenticating whether a cartridge body portion 505 is within a corresponding series authorized for use with the control body portion 506 (i.e., the control body portion is configured for use only with Series X, Y, or Z cartridge body portions, wherein a Series N cartridge body portion would not be configured to provide a suitable authentication indicia to allow that cartridge body portion to be used with the noted control body portion). Accordingly, in particular aspects, the first control component 520 may be configured to be responsive to the received authentication indicia from the engaged cartridge body portion 505, authorizing the particular cartridge body portion 505 for use with the control body portion 506, to allow current flow from the electrical power source 540 to the at least one heating element 560, for example, upon actuation of the puff sensor 530 by a user. In such aspects, if no authentication indicia is received by the first control component 520 (i.e., an absent authentication indicia) or if an unauthorized authentication indicia is received by the first control component 520, the first control component 520 may respond, for example, by disallowing or preventing current flow from the electrical power source 540 to the at least one heating element 560.

In some aspects, the cartridge body portion 505 may also include a memory device 600 in communication with the second control component 590. In such aspects, the second control component 590 may be configured, for example, to determine a remaining amount of the aerosol precursor composition in the reservoir 550 and to store the determined remaining amount in the memory device 600. Such functionality may be actuated in various manners upon the cartridge body portion 505 being engaged with the control body portion 506. For instance, the second control component 590, upon being energized by the electrical power source 540, may be configured to periodically poll or monitor the reservoir 550 to determine the remaining amount of the aerosol precursor composition therein (i.e., through an appropriate sensor operably engaged with the reservoir 550 to determine the amount of the aerosol precursor composition therein or to otherwise determine a quantity of the aerosol precursor composition flowing from the reservoir 550 to the wick). In other instances, such functionality may be actuated upon each puff, or a predetermined quantity of puffs, by the user. In some aspects, the second control component 590 may be configured to monitor the number of puffs, in addition to the volume and/or duration of each puff, such that the resulting calculated amount of used aerosol precursor composition used by the user can be compared to the capacity of the aerosol precursor composition in the reservoir, so as to determine the remaining amount of the aerosol precursor composition in the reservoir 550. In any instance, the determined remaining amount of the aerosol precursor composition in the reservoir 550 may be periodically determined and indicated to the user of the smoking article 500, for example, through any of the one or more of the status indicators 580. Further, the first and second control components 520, 590 may be configured to communicate the determined remaining amount therebetween. For example, the first control component 520 may be configured to be responsive to a threshold level of the determined remaining amount of the aerosol precursor composition received from the second control component 590 to actuate a low remaining amount indicia (selected from the status indicators 580) associated with the control body portion 506. In this regard, the second control component 590 may be configured to assess whether the remaining amount of the aerosol precursor composition in the reservoir 550 has reached or is below the threshold level of the amount of the aerosol precursor composition. Alternatively, the second control component 590 may be, for example, configured to monitor the saturation level of the wick by way of a capacitive sensor or other suitable sensor, whereby the reservoir 550 is determined to be at or below the threshold level when the saturation level of the wick falls below a particular level. The first control component 520 would thus be configured to be responsive to the determination of the second control component 590 as to whether the cartridge body portion 505 is spent and requires replacement. In other instances, the second control component 590 may just communicate the determined remaining amount, whether on demand from the first control component 520, or through a periodic polling by the first control component in which the remaining amount may be determined in response thereto or retrieved from the memory device 600, and the determination as to whether the threshold level has been reached may be determined by the first control component 520. In addition to or in the alternative to indicating the low remaining amount of the aerosol precursor composition, the first control component may be configured to take other action such as, for instance, disallowing or preventing electrical current from flowing the heating element 560, thereby requiring replacement of the spent cartridge body portion 505.

Figure 7:
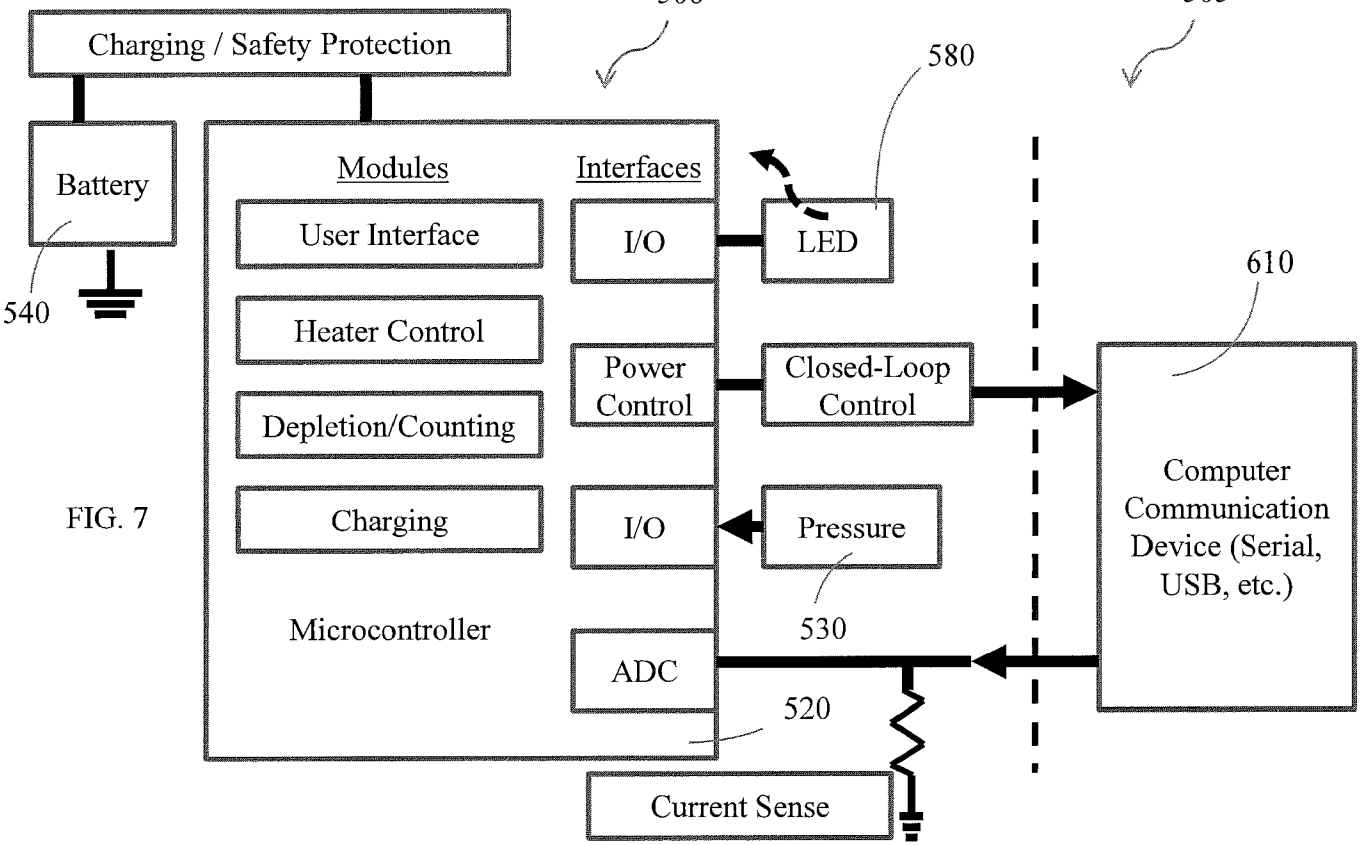
FIG. 7 is a schematic of operational components of a smoking article arranged to provide data collection, as well as external communication, according to one aspect of the disclosure.

In some aspects, the control body portion 506 may further include a communication device 610 (see, e.g., FIG. 7) operably engaged with the first control component 520 and/or the electrical power source 540, wherein the communication device 610 (i.e. an appropriate transmitter or transceiver) may at least be configured to transmit data externally to the smoking article 500, for example, data from one of the first and second control components 520, 590 or the memory device 600. In other instances, the communication device 610 may instead be operably engaged with the second control component 590 and thus contained and included in the cartridge body portion 505. In such aspects involving a communication device 610, data regarding the smoking article 500 and/or use thereof may be transmitted to an external location associated with the manufacturer, distributor, retailer, or any other entity authorized thereby. Still further, the communication device 610 may be used, in some instances, to update the operational software associated with the first and/or second control component and/or upload data to the memory device 600. Also, the communication device 610 may be configured to allow the user to receive data associated with the control and cartridge body portions 506, 505 associated with the particular smoking article 500 to be received by other electronic devices associated with the user. For example, data collected by the second control portion 590 or otherwise stored in the memory device 600 may be received by the PDA, smart phone, PC, laptop, or tablet device associated with the user, via the communication device 610, so as to allow the user so to view or manipulate the data. Further, the communication device 610 may allow the smoking article 500 to otherwise communicate with a corresponding application configured to be executed by the other electronic devices associated with the user. In this manner, the smoking article 500 may be queried by the user's other electronic devices or otherwise be configured to be configured for on-demand communication therewith.

In yet other aspects, the memory device 600 may be configured to include a unique identifying indicia associated with the cartridge body portion 505, wherein such a unique identifying indicia may comprise, for example, a serial number associated with the cartridge body portion 505. In particular instances, the unique identifying indicia may be configured to be received by the first control component 520 directly from the memory device 600 or via the second control component 590. The first control component 520 may also be configured to direct the unique identifying indicia to the external location, via the communication device 610, wherein the unique identifying indicia may further be associated, for instance, with an identifying indicia for the control body portion 506. The identifying indicia for the control body portion 506 may be previously registered or otherwise associated with a particular or specified user and, as such, the user may be credited with purchase or use of the particular cartridge body portion associated with the unique identifying indicia, for example, in a loyalty or rewards program. The collected unique identifying indicia may be convertible, in some instances, to coupons or other reward program features that may be directed to the user to encourage the user to buy more like products. In other instances, the unique identifying indicia may be associated with manufacturing data for the cartridge body portion 505 such that date code, batch number, or other tracking information can be made known to the external location.

In other aspects, the memory device 600 may be configured to include a composition indicia associated with the aerosol precursor composition contained in the reservoir 550 associated with the cartridge body portion 505. The composition indicia may have associated therewith, for example, heating parameters required to transform the aerosol precursor composition into an aerosol. Upon engagement between the control and cartridge body portions 506, 505, the composition indicia may be directed from the memory device 600, in some instances via the second control component 590, to the first control component 520. The first control component 520 may, in turn, be configured to be responsive to the composition indicia to selectively actuate current flow from the electrical power source 540 housed by the control body portion 506. The current flow may then be directed to the at least one heating element 560 housed by the cartridge body portion 505, and the at least one heating element 560 may be responsive to the current flow to provide the required heating parameters for heating the aerosol precursor composition to form the aerosol.

Still another aspect of the present disclosure, the first and/or second control component 520, 590 may be configured to monitor usage parameters associated with, for example, the aerosol precursor composition, the at least one heating element 560, and the electrical power source 540, as well as the various sensors and the status indicators, as necessary or desired. Other components may be included in the smoking article 500 to particularly contribute to such usage parameters. For example, a geo-locating device, such as a GPS device (not shown), may be included in the smoking article 500 so as to determine a location of the smoking article 500 upon usage thereof by the user. In some instances, data associated with the usage parameters may be stored in the memory device 600. In yet other instances, the collected data associated with such usage parameters may be directed to the external location by the communication device 610. Such data regarding usage parameters may include, for example, puff duration and frequency, battery condition and/or level, preferred flavors, usage according to location, usage according to time of day, or any other appropriate usage parameter necessary or desired. Such data regarding usage parameters may be collected and used, for instance, by marketing focus groups, business analysts, or any other appropriate analysis entity.

In some particular instances, the first and/or second control component 520, 590 may be configured to monitor particular usage parameters associated with the smoking article 500 and/or the user thereof. Such collected usage data may include, for example, the average number of puffs taken per cartridge (i.e., the number of puffs that the user can take before the reservoir 550 of the cartridge body portion 505 is considered spent or empty), the total number of puffs taken per cartridge or cumulatively in relation to the control body portion 506, the number of puffs taken before the electrical power source 540 (i.e., battery) needs to be recharged, the number of cartridges that can be used before the electrical power source 540 needs to be recharged, the total number of cartridges used in relation to the particular control body portion 506, or any other usable metric or statistical data associated with the smoking article 500 and/or the user thereof.

Many modifications and other embodiments of the disclosure will come to mind to one skilled in the art to which this disclosure pertains having the benefit of the teachings presented in the foregoing descriptions and the associated drawings. For example, kits can be provided that include a variety of components as described herein. For example, a kit can comprise a control body portion with one or more cartridge body portions. A kit further can comprise a control body portion with one or more charging components. A kit further can comprise a control body portion with one or more batteries. A kit further may comprise a control body portion with one or more cartridge body portions and one or more charging components and/or one or more batteries. In further embodiments, a kit may comprise a plurality of cartridge body portions. A kit further may comprise a plurality of cartridge body portions and one or more batteries and/or one or more charging components. The inventive kits further can include a case (or other packaging, carrying, or storage component) that accommodates one or more of the kit components. The case could be a reusable hard or soft container. Further, the case could be simply a box or other packaging structure. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A smoking article comprising:

a control body portion having a control body engagement end, the control body portion having a control component therein; and a cartridge body portion configured to engage the control body portion, the cartridge body portion having a cartridge body engagement end configured to removably engage the control body engagement end and a mouth end defining an opening at an end opposite the cartridge body engagement end, the cartridge body including:

a consumable arrangement comprising:

a reservoir storing at least an aerosol precursor composition, wherein the aerosol precursor composition comprises a liquid consisting of at least one of polyhydric alcohol, nicotine, a flavorant, and an acid;

a resistive heating element operably engaged with the aerosol precursor composition and defining a heating zone in proximity thereto;

a wick configured to extend from the reservoir to the resistive heating element to draw the aerosol precursor composition from the reservoir and into the heating zone for aerosolization of the aerosol precursor composition; and a fluid passage extending from the heating zone to the mouth end, the fluid passage being configured to direct the aerosolized aerosol precursor composition from the heating zone to the opening in the mouth end in response to suction applied thereto, wherein the control component is configured to:

determine engagement of the control body portion with the cartridge body portion;

output a first electrical current flow in response to determining engagement of the control body portion with the cartridge body portion and authenticating the cartridge body portion;

in response to the authenticated cartridge body portion, designate the smoking article as being of an active status and actuate a first status indicator indicative of the active status;

actuate a second status indicator in response to detection of the suction applied to the opening in the mouth end of the smoking article;

output a second electrical current flow from an electrical power source to the resistive heating element in response to the suction applied to the opening in the mouth end of the smoking article so as to aerosolize the aerosol precursor composition to form an aerosol; and selectively regulate the second electrical current flow through a regulator component of the control component and based at least in part on a resistance associated with the resistive heating element through a regulator component of the control component.

2. The smoking article of claim 1, wherein the electrical power source is included in the control body portion.

3. The smoking article of claim 1, wherein the electrical power source is selected from the group consisting of a battery, a capacitor, and combinations thereof.

4. The smoking article of claim 1, wherein the control body includes a memory device in communication with the control component.

5. The smoking article of claim 1, wherein the fluid passage extending from the heating zone includes an opening adjacent to the heating zone adapted for exit of the aerosolized aerosol precursor composition from the heating zone.

6. The smoking article of claim 1, wherein the smoking article comprises charging contacts for interaction with corresponding contacts in a charging unit.

7. The smoking article of claim 6, wherein the charging unit includes a USB connection.

8. The smoking article of claim 1, wherein the smoking article comprises a USB connection configured to enable recharging of the electrical power source.

9. The smoking article of claim 1, wherein the electrical power source is configured for non-contact, inductive charging from an external power source.

10. The smoking article of claim 1, wherein the cartridge body portion includes an air intake.

11. The smoking article of claim 1, wherein one or more of the control component and an associated sensor are configured to:

detect the suction applied to the opening in the mouth end of the smoking article using the associated sensor;

determine cessation of the suction applied to the opening in the mouth end of the smoking article and, in response to the cessation of the suction applied to the opening in the mouth end of the smoking article, discontinue provision of the second electrical current flow to the resistive heating element; and determine that a defined time lapse has occurred since cessation of the suction applied to the opening in the mouth end of the smoking article and deactivate a function of the smoking article.

12. The smoking article of claim 1, further comprising an accelerometer, wherein the smoking article is configured to provide a function in response to motion detected by the accelerometer.

13. The smoking article of claim 12, wherein the function comprises illumination of the first status indicator comprising an indicator light.

14. The smoking article of claim 13, wherein illumination of the indicator light comprises illumination of the indicator light in one of a plurality of available colors selected based on a status of the smoking article.

15. The smoking article of claim 1, wherein the control component is configured to perform a function in response to engagement of the cartridge body portion with the control body portion.

16. The smoking article of claim 15, wherein the control component is configured to cause illumination of an indicator light after engagement of the control body portion with the cartridge body portion.

17. The smoking article of claim 1, wherein the cartridge body portion is configured to engage the control body portion through a press-fit engagement.

18. The smoking article of claim 1, wherein the cartridge body portion is configured to engage the control body portion through magnetic engagement.

19. A kit comprising packaging containing at least:

a control body portion according to claim 1;

at least one cartridge body portion according to claim 1; and a charging component configured to engage the control body portion.

* * * * *